US010939217B2

(12) United States Patent
Monti et al.

(10) Patent No.: US 10,939,217 B2
(45) Date of Patent: Mar. 2, 2021

(54) AUDIO DEVICE WITH ACOUSTIC VALVE

(71) Applicant: Knowles Electronics, LLC, Itasca, IL (US)

(72) Inventors: Christopher Monti, Elgin, IL (US); Shehab Albahri, Hanover Park, IL (US); Erik Wiederholtz, St. Charles, IL (US); Charles King, Oak Park, IL (US); Christopher Jones, Carpentersville, IL (US); Timothy Wickstrom, Elk Grove Village, IL (US); Thomas Miller, Arlington Heights, IL (US); Brenno Varanda, Hoffman Estates, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/236,378

(22) Filed: Dec. 29, 2018

(65) Prior Publication Data

US 2019/0208343 A1 Jul. 4, 2019

Related U.S. Application Data

(60) Provisional application No. 62/611,937, filed on Dec. 29, 2017.

(51) Int. Cl.
*H04R 25/00* (2006.01)
*H04R 1/10* (2006.01)

(52) U.S. Cl.
CPC ..... *H04R 25/652* (2013.01); *H04R 25/456* (2013.01); *H04R 1/1041* (2013.01);
(Continued)

(58) Field of Classification Search
CPC .. H04R 25/652; H04R 25/654; H04R 25/658; H04R 25/456; H04R 1/1041;
(Continued)

(56) References Cited

U.S. PATENT DOCUMENTS 2,301,744 A 5/1941 Olsen
3,835,263 A 9/1974 Killion
(Continued)

FOREIGN PATENT DOCUMENTS

CN 1130459 A 9/1996
DE 2614579 A1 10/1977
(Continued)

OTHER PUBLICATIONS

European Patent Office; Extended European Search Report; EP Application No. 09819815.3; dated Jul. 25, 2013.
(Continued)

*Primary Examiner* — Fan S Tsang
*Assistant Examiner* — Angelica M McKinney
(74) *Attorney, Agent, or Firm* — Faegre Drinker Biddle & Reath LLP

(57) ABSTRACT

A hearing device such as a hearing aid, ear pod, headphone, or other wearable is provided, whose components include the following: an acoustic transducer with a vent port operable to produce sound, a housing of the acoustic transducer with a sound opening, and an actuatable acoustic valve disposed in the housing, where the acoustic valve is actuatable to alter passage of sound through the acoustic vent to change the state of the hearing device between an open vent state and a closed vent state, so that actuation of the valve changes an acoustic characteristic of the hearing device.

11 Claims, 18 Drawing Sheets

(52) U.S. Cl.
CPC ..... *H04R 25/604* (2013.01); *H04R 2225/025* (2013.01); *H04R 2225/61* (2013.01); *H04R 2460/11* (2013.01)

(58) Field of Classification Search
CPC ..... H04R 1/1058; H04R 5/0335; H04R 2225/025; H04R 2225/61; H04R 2460/11
See application file for complete search history.

(56) References Cited

U.S. PATENT DOCUMENTS

| | | | | |
|---|---|---|---|---|
| 3,836,732 | A | 9/1974 | Johanson et al. | |
| 3,876,749 | A | 4/1975 | Horvath et al. | |
| 3,975,599 | A | 8/1976 | Johanson | |
| 4,133,984 | A * | 1/1979 | Akiyama | H04R 25/456 181/135 |
| 4,142,072 | A | 2/1979 | Berland | |
| 4,605,197 | A | 8/1986 | Casey | |
| 4,756,312 | A | 7/1988 | Epley | |
| 4,800,982 | A | 1/1989 | Carlson | |
| 4,867,267 | A | 9/1989 | Carlson | |
| 4,893,655 | A | 1/1990 | Anderson | |
| 5,033,090 | A | 7/1991 | Weinrich | |
| 5,068,901 | A * | 11/1991 | Carlson | H04R 1/225 381/325 |
| 5,220,612 | A | 6/1993 | Tibbetts et al. | |
| 5,259,035 | A | 11/1993 | Peters et al. | |
| 5,349,986 | A | 9/1994 | Sullivan et al. | |
| 5,357,576 | A | 10/1994 | Arndt | |
| 5,524,056 | A | 6/1996 | Killion et al. | |
| 5,631,965 | A * | 5/1997 | Chang | A61F 11/08 381/72 |
| 5,692,060 | A | 11/1997 | Wickstrom | |
| 5,757,933 | A | 5/1998 | Preves et al. | |
| 5,785,661 | A | 7/1998 | Shennib | |
| 5,835,608 | A | 11/1998 | Warnaka et al. | |
| 5,990,425 | A | 11/1999 | McSwiggen | |
| 6,068,079 | A | 5/2000 | Hamery et al. | |
| 6,075,869 | A | 6/2000 | Killion et al. | |
| 6,134,334 | A | 10/2000 | Killion et al. | |
| 6,151,399 | A | 11/2000 | Killion et al. | |
| 6,549,635 | B1 | 4/2003 | Gebert | |
| 7,136,497 | B2 | 11/2006 | McSwiggen | |
| 7,458,395 | B2 | 12/2008 | Haynes et al. | |
| 7,478,702 | B2 | 1/2009 | Berg | |
| 7,548,629 | B1 | 6/2009 | Griffin | |
| 7,740,104 | B1 | 6/2010 | Parkins | |
| 7,784,583 | B1 | 8/2010 | Hall | |
| 8,096,383 | B2 | 1/2012 | Saltykov | |
| 8,199,955 | B2 | 6/2012 | Akino | |
| 8,338,898 | B2 | 12/2012 | Schrank et al. | |
| 8,391,527 | B2 | 3/2013 | Feucht | |
| 8,798,304 | B2 * | 8/2014 | Miller | H04R 1/326 381/328 |
| 8,923,543 | B2 | 12/2014 | Sacha | |
| 9,185,480 | B2 * | 11/2015 | Howes | H04R 1/086 |
| 9,525,929 | B2 | 12/2016 | Burgett | |
| 9,706,290 | B2 * | 7/2017 | Grinker | H04R 1/1016 |
| 2003/0059075 | A1 | 3/2003 | Niederdrank | |
| 2004/0046137 | A1 | 3/2004 | Herbert et al. | |
| 2006/0108552 | A1 | 5/2006 | Herbert et al. | |
| 2006/0137934 | A1 | 6/2006 | Kurth | |
| 2007/0075284 | A1 | 4/2007 | Masamura et al. | |
| 2007/0086599 | A1 | 4/2007 | Wilmink | |
| 2007/0176720 | A1 | 8/2007 | Janssen et al. | |
| 2008/0181443 | A1 | 7/2008 | Harvey et al. | |
| 2010/0111340 | A1 | 5/2010 | Miller et al. | |
| 2011/0182453 | A1 * | 7/2011 | Van Hal | H04R 25/60 381/328 |
| 2012/0082335 | A1 | 4/2012 | Duisters | |
| 2014/0169579 | A1 | 6/2014 | Azmi | |
| 2014/0169603 | A1 | 6/2014 | Sacha et al. | |
| 2015/0041931 | A1 | 2/2015 | Szczech et al. | |
| 2016/0150310 | A1 * | 5/2016 | Bakalos | H04R 1/1083 381/372 |
| 2016/0255433 | A1 * | 9/2016 | Grinker | H04R 1/1016 381/380 |
| 2017/0055086 | A1 * | 2/2017 | van Gilst | H04R 1/24 |
| 2017/0208382 | A1 * | 7/2017 | Grinker | G10K 11/17881 |
| 2017/0251292 | A1 | 8/2017 | Wiederholtz | |
| 2018/0091892 | A1 * | 3/2018 | Taylor | H04R 1/2811 |
| 2018/0109862 | A1 | 4/2018 | Lawand | |
| 2019/0116436 | A1 | 4/2019 | Lawland | |
| 2019/0116437 | A1 | 4/2019 | Bolsman | |
| 2019/0166238 | A1 * | 5/2019 | Gilmore | H04R 1/086 |
| 2019/0208301 | A1 | 7/2019 | Monti | |
| 2019/0208343 | A1 | 7/2019 | Monti | |
| 2019/0215620 | A1 | 7/2019 | Albahri | |
| 2019/0215621 | A1 | 7/2019 | Albahri | |
| 2019/0320272 | A1 | 10/2019 | Jones | |

FOREIGN PATENT DOCUMENTS

| | | | |
|---|---|---|---|
| DE | 4422972 | A1 | 1/1996 |
| EP | 0455203 | A2 | 11/1991 |
| EP | 2747455 | A2 | 6/2014 |
| EP | 3177037 | A2 | 6/2017 |
| EP | 2835987 | | 8/2017 |
| FR | 2596644 | A1 | 10/1987 |
| KR | 10-0517059 | B1 | 9/2005 |
| KR | 1020080001568 | A | 1/2008 |
| WO | 1995007014 | A1 | 3/1995 |
| WO | 1997009864 | A1 | 3/1997 |
| WO | 1997030565 | A1 | 8/1997 |
| WO | 1998047318 | A1 | 10/1998 |
| WO | 1998057081 | A1 | 12/1998 |
| WO | 0027166 | A2 | 5/2000 |
| WO | 2006061058 | A1 | 6/2006 |
| WO | 2007107736 | A2 | 9/2007 |
| WO | 2008022048 | A2 | 2/2008 |
| WO | 2010042613 | A2 | 4/2010 |

OTHER PUBLICATIONS

European Patent Office; Extended European Search Report; EP Application No. 09819815.3; dated Dec. 22, 2016.
International Search Report and Written Opinion; International Application No. PCT/US2009/059829; dated May 20, 2010.
International Search Report and Written Opinion; International Application No. PCT/US2019/063321; dated Mar. 3, 2020.

* cited by examiner

AUDIO DEVICE WITH ACOUSTIC VALVE

RELATED APPLICATIONS

This application relates to U.S. Provisional Patent Application Ser. No. 62/611,937 filed on Dec. 29, 2017, and entitled "Audio Device with Acoustic Valve," the entire contents of which is hereby incorporated by reference.

TECHNICAL FIELD

This disclosure relates generally to audio devices and, more specifically, to audio devices that have different modes of operation.

BRIEF DESCRIPTION OF THE DRAWINGS

For a more complete understanding of the disclosure, reference should be made to the following detailed description and accompanying drawings wherein.

Figure 1:
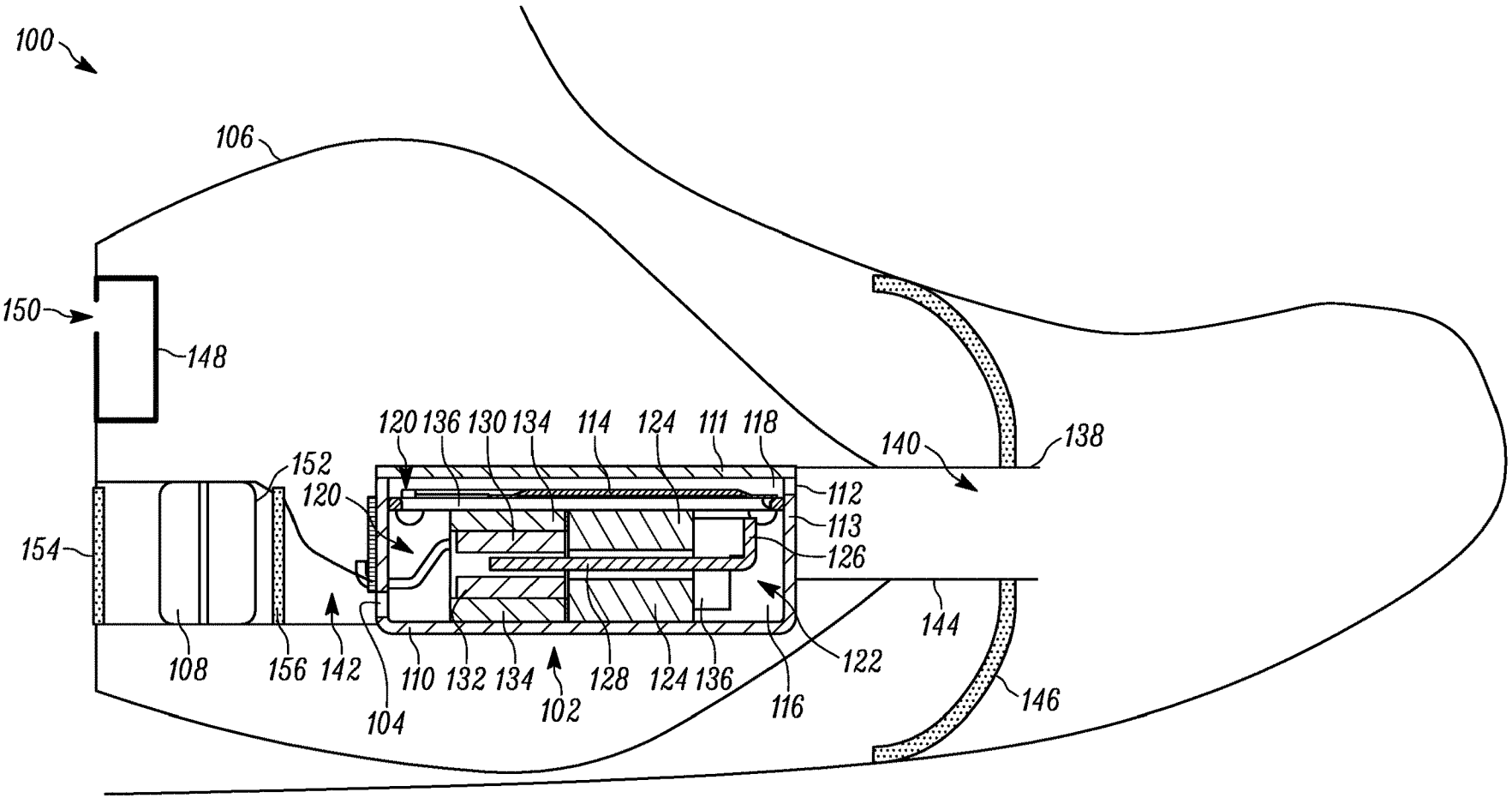
FIG. 1 is a schematic diagram illustrating a hearing device in accordance with one example set forth in the disclosure, wherein the hearing device is located partially inside the user's ear canal.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. The terms and expressions used herein have the ordinary technical meaning as is accorded to such terms and expressions by persons skilled in the technical field as set forth above except where different specific meanings have otherwise been set forth herein.

DETAILED DESCRIPTION

The present disclosure pertains to hearing devices configurable with a valve actuatable between an open state and a closed state, wherein actuation of the valve changes an acoustic characteristic of the hearing device. In some embodiments the valve provides adjustable internal volumes that can increase the response and the maximum power output (MPO) of an acoustic transducer by providing the acoustic transducer with a larger internal volume by opening the acoustic valve to acoustically couple the internal volume with an effectively unbounded volume external to the housing, such as the ambient atmosphere, or with a closed volume inside the housing, as appropriate. The valve may be actuatable in situ without having to remove the hearing device from the user's ear to adjust between an open state and a closed state depending on the user's desire or other context, in which different states provide different acoustic characteristics of the hearing device.

The teachings of the present disclosure are generally applicable to hearing devices including an electroacoustic transducer disposed in a housing having a portion configured to form a seal with the user's ear. The seal may be formed by an ear dome or other portion of the hearing device. In some embodiments, the hearing device is a receiver-in-canal (RIC) device for use in combination with a behind-the-ear (BTE) device including a battery and an electrical circuit coupled to the RIC device by a connector that extends about the user's ear. The RIC typically includes an electro-acoustic transducer disposed in a housing having a portion configured for insertion at least partially into a user's ear canal. In other embodiments, the hearing device is an in-the-ear (ITE) device or a completely-in-canal (CIC) device containing the transducer, electrical circuits and all other components. In another embodiment, the hearing device is a behind-the-ear (BTE) device containing the transducer, electrical circuits and all other components except for a sound tube that extends into the ear. The teachings of the present disclosure are also applicable to over-the-ear devices, earphones, ear buds, ear pods, wireless headsets and in-ear devices among other wearable devices that emit sound. These and other applicable hearing devices typically include an electro-acoustic transducer operable to produce sound.

In embodiments that include an electro-acoustic transducer, the transducer generally includes a diaphragm that separates a volume within a housing of the hearing device into a front volume and a back volume. A motor actuates the diaphragm in response to an excitation signal applied to the motor. Actuation of the diaphragm moves air from a volume of the housing and into the user's ear via a sound opening of the hearing device. Such a transducer may be embodied as a balanced armature receiver or as a dynamic speaker among other known and future transducers.

In accordance with one aspect of the present disclosure, a hearing device such as a hearing aid, ear pod, headphone, or other wearable, includes an acoustic transducer with a vent port, a housing of the acoustic transducer with a sound opening, and an actuatable acoustic valve disposed in the housing. The acoustic valve is actuatable to alter passage of sound through the acoustic vent to change the state of the hearing device between an open vent state and a closed vent state, so that actuation of the valve changes an acoustic characteristic of the hearing device.

In one embodiment, the acoustic transducer includes a transducer housing having a sound port and a diaphragm separating an internal volume of the hearing device into a back volume and a front volume. The front volume and the back volume are defined by a transducer housing. The transducer housing may be a discrete housing disposed within a housing of the hearing device or the transducer housing may be defined, in whole or in part, by the hearing device housing. Generally, the housing may comprise several parts that when combined make up the outer surface of the housing, acoustic vent passages, and in some embodiments all or a part of the transducer housing. The vent port is disposed through the housing and acoustically coupled to the internal volume. The housing has a sound opening to which the front volume of the transducer housing is acoustically coupled. The housing also has a portion configured to be disposed at least partially in a user's ear, so that sound from the sound port of the front volume emanates into the user's ear through the sound opening when the portion of the housing is at least partially disposed in the user's ear. The acoustic valve has a first port that is acoustically coupled to the internal volume of the transducer via the vent port of the transducer housing, so that the valve is acoustically coupled to a volume external to the transducer housing. In one aspect of the embodiment, acoustic impedance between the internal volume of the transducer and the volume external to the transducer housing is greater when the valve is in the closed state than when the valve is in the open state. In another aspect of the embodiment, the actuation of the valve changes an acoustic output of the hearing device.

In one embodiment, the valve of the hearing device is acoustically coupled to the front volume of the transducer via the vent port. In one embodiment, the hearing device has a nominal acoustic performance when the valve is in the closed state. The nominal acoustic performance has a first resonant frequency which is decreased when the valve is in the open state. When the valve is in the open state, an acoustic output of the hearing device is decreased at frequencies higher than the first resonant frequency. In another embodiment, the volume external to the transducer housing is a closed volume internal to the housing. Sound passes more freely between the front volume of the transducer and the closed volume when the valve is in the open state than when the valve is in the closed state.

In one embodiment, the hearing device has a nominal acoustic performance when the valve is in the closed state. The volume external to the transducer housing is an effectively unbounded volume external to the housing, for example the ambient atmosphere outside the user's ear and the housing when portion of the housing is disposed at least partially in the user's ear. Sound passes more freely between the effectively unbounded volume and the sound opening when the valve is in the open state than when the valve is in the closed state. The acoustic output of the hearing device is decreased over a wide range of frequencies when the valve is in the open state. For example, if the hearing device is an ear pod that is playing music, sound from the unbounded volume passes through the ear pod while the sound output, which in this case is the music that the ear pod is playing, is decreased, in order to make it easier for the user to hear people talking. In another embodiment, a sound transmissive contamination barrier is disposed between the volume external to the housing and the valve.

In one embodiment, the acoustic valve is acoustically coupled to the back volume via the vent port. In another embodiment, the hearing device has a nominal acoustic performance when the valve is in the closed state. The nominal acoustic performance includes a first resonant frequency. When the valve is in the open state, the hearing device has a new first resonant frequency and an acoustic output of the hearing device is increased at frequencies less than the new first resonant frequency. In one embodiment, the volume external to the transducer housing is a closed volume internal to the housing. In another embodiment, the volume external to the transducer housing is an effectively unbounded volume external to the housing. In one embodiment, a sound transmissive contamination barrier is disposed between the volume external to the housing and the valve.

In one embodiment, the volume external to the transducer housing is an effectively unbounded volume external to the housing. Passage of sound between the transducer and the unbounded volume is attenuated more when the valve is in the closed state than when the valve is in the open state. In another embodiment, the volume external to the transducer housing is an effectively unbounded volume external to the housing. Passage of sound between the unbounded volume and the sound opening is relatively attenuated when the valve is in the closed state than when the valve is in the open state. In yet another embodiment, an acoustic damper is disposed between the vent port of the acoustic transducer and the volume external to the transducer housing. The acoustic damper is used to smooth or otherwise shape a frequency response in the hearing device. In one embodiment, the transducer is a balanced armature receiver including a motor in the back volume. In one embodiment, at least a portion of the housing forms at least a portion of the transducer housing. In another embodiment, the volume external to the transducer housing is integral to the valve.

In one embodiment, the hearing device has two vent ports: a first vent port disposed through the transducer housing and acoustically coupled to the front volume, and a second vent port disposed through the transducer housing and acoustically coupled to the back volume. The hearing device also has an acoustic valve disposed in the housing, with the valve having two ports: a first port acoustically coupled to the front volume via the first vent port, and a second port acoustically coupled to the back volume via the second vent port.

FIG. 1 illustrates one example of a hearing device 100 in which an acoustic valve is acoustically coupled to the back volume of an acoustic transducer via a vent port, and the volume external to a transducer housing is an effectively unbounded volume external to a housing. The hearing device 100 is a hearing assembly, including but not limited to a RIC, ear pod, or headphone assembly, among other hearing devices configured for at least a partial insertion on or into a user's ear such that, when the hearing device 100 is in a closed state, sounds traveling between the ear cavity on the inside of the ear canal and the ambient atmosphere can be substantially blocked while the hearing device 100 is in use. In this example, the hearing device 100 includes an acoustic transducer 102 with a vent port 104, a housing 106, and an actuatable acoustic valve 108.

In FIG. 1, a sound-producing electroacoustic transducer 102 includes a transducer housing 110, with a cover 111, a sound port 112, and a cup 113. More generally however the housing 106 may form a portion, or all, of the transducer housing 110. The acoustic transducer 102 is embodied as a balanced armature receiver including a diaphragm 114 which separates the inside volume of the transducer housing 110 into a back volume 116 and a front volume 118. The front volume 118 is partially defined by the cover 111 and the diaphragm 112. The sound port 112, which is acoustically coupled to the ear canal once the hearing device 100 is at least partially inserted into the ear canal, is defined by the cover 111 and the cup 113 of the acoustic transducer 102. Also, the front volume 118 is acoustically coupled to the sound port 112. However, any suitable sound-producing electroacoustic acoustic transducer may be employed including but not limited to dynamic speakers.

In FIG. 1, the transducer 102 includes a motor 122 disposed in the back volume 116. The motor 122 includes a coil 124 disposed about a portion of an armature 126. A movable portion 128 of the armature 126 is disposed in equipoise between magnets 130 and 132. The magnets 130 and 132 are retained by a yoke 134. The diaphragm 114 is movably coupled to a support structure 136 of the transducer housing 110. Application of an excitation signal to the coil 124 modulates the magnetic field, causing deflection of the armature 126 between the magnets 130 and 132. The deflecting armature 126 is linked to the diaphragm 114 disposed within the transducer housing 110, wherein movement of the diaphragm 114 forces air through the sound port 112 of the transducer housing 110. Movement of the diaphragm 112 results in changes in air pressure in the front volume 118 wherein acoustic pressure (e.g., sound) is emitted through the sound port 112 of the transducer 102. Armature receivers suitable for the embodiments described herein are available from Knowles Electronics, LLC. Extending from the acoustic transducer are wires which transmit electrical signals that include, for example, a driving signal of the acoustic transducer 102 and an electrical current to change the state of the valve 108 between the open state and the closed state.

In FIG. 1, the housing 106 includes a sound opening 138 located at an end portion 140 of the housing 106 disposed on or in the user's ear. The sound opening 138 is acoustically coupled to the front volume 118, and sound produced by the acoustic transducer 102 emanates from the sound port 112 of the front volume 118 through the sound opening 138 of the housing 106 and into the user's ear. The vent port 104 is coupled to the back volume 116. An acoustic passage 142 extends from the vent port 104 through the housing 106 and is coupled to the ambient atmosphere. The acoustic passage 142 also defines a volume external to the transducer housing 110 connecting the vent port 104 to the acoustic valve 108. The acoustic valve 108 is acoustically coupled to the back volume 116 of the transducer housing 110. Therefore, when the acoustic valve 108 is in the open state, the back volume 116 of the acoustic transducer 102 is acoustically coupled to the effectively unbounded volume external to the housing 110, which is also the ambient atmosphere. When in the closed state the valve 108 increases the acoustic impedance in the vent path between the vent port 104 and the ambient atmosphere.

The housing 106 also includes a nozzle 144 which defines the end portion 140, connected to an ear tip 146 which is used to at least partially seal to the ear canal once the hearing device is at least partially inserted into the user's ear. The seal improves transmission of low frequency sound from the hearing device to the user's ear. The ear tip 146 may be made of any material as deemed suitable for the use of the hearing device, including but not limited to foams, silicone, plastic, or rubber. Any suitable ear tip may be employed and different shapes of the ear tip may be employed, such as double- or triple-flanged earbud tips, as appropriate, in order to provide a more complete or more reliable seal for the user while the hearing device is at least partially inserted inside the ear canal.

In some embodiments, the housing 106 includes a microphone 148 with a microphone port 150 located to detect ambient sound external to the housing when the hearing device is in use. In one example, the hearing device is a hearing aid, and the microphone is used for amplifying the ambient sound before feeding the amplified sound into the user's ear from the acoustic transducer. In another example, the hearing device is an active noise-cancelling headphone which uses the microphone to capture the ambient sound and creates, using a noise-cancelling circuitry also coupled with the microphone, sound waves that are 180 degrees out of phase with the sound waves of the incoming ambient sound, so that when the two kinds of sound waves are combined, the incoming ambient sound is reduced considerably through destructive interference. In another use case, the microphone senses the user's voice for use in voice communications, for example, telephone calls.

In FIG. 1, the acoustic valve 108 is located in the acoustic passage 142 and has a first port 152 coupled to the vent port 104. A sound transmissive contamination barrier 154 is placed in the acoustic passage 142 between the acoustic valve 108 and an effectively unbounded volume, or the ambient atmosphere, external to the housing 106, so that the barrier 154 acts as a filter which at least partially protects the acoustic valve 108 and the acoustic transducer 102 from contaminants such as dirt, dust, water, or other foreign substances which may enter the acoustic passage 142 from the ambient atmosphere. The barrier 154 may be configured to provide minimal acoustic impedance or it may be configured to act as a damper in order to influence the acoustic response of the hearing device 100. The barrier 154 can be made of a porous material. A damper 156 may also be placed in the acoustic passage 142 between the first port 152 and the vent port 104. The damper 156 can be acoustic cloth screens, for example, to be inserted inside the acoustic passage 142, which for example can be an acoustic tubing. Such damping elements are used to smooth or otherwise shape the frequency response of the hearing device 100. Any suitable acoustic valve may be employed for the acoustic valve 108, including but not limited to the acoustic valve as disclosed in U.S. Pat. No. 8,798,304 assigned to Knowles Electronics, LLC. Any suitable acoustic damper may be employed for the damper 156.

Figure 2:
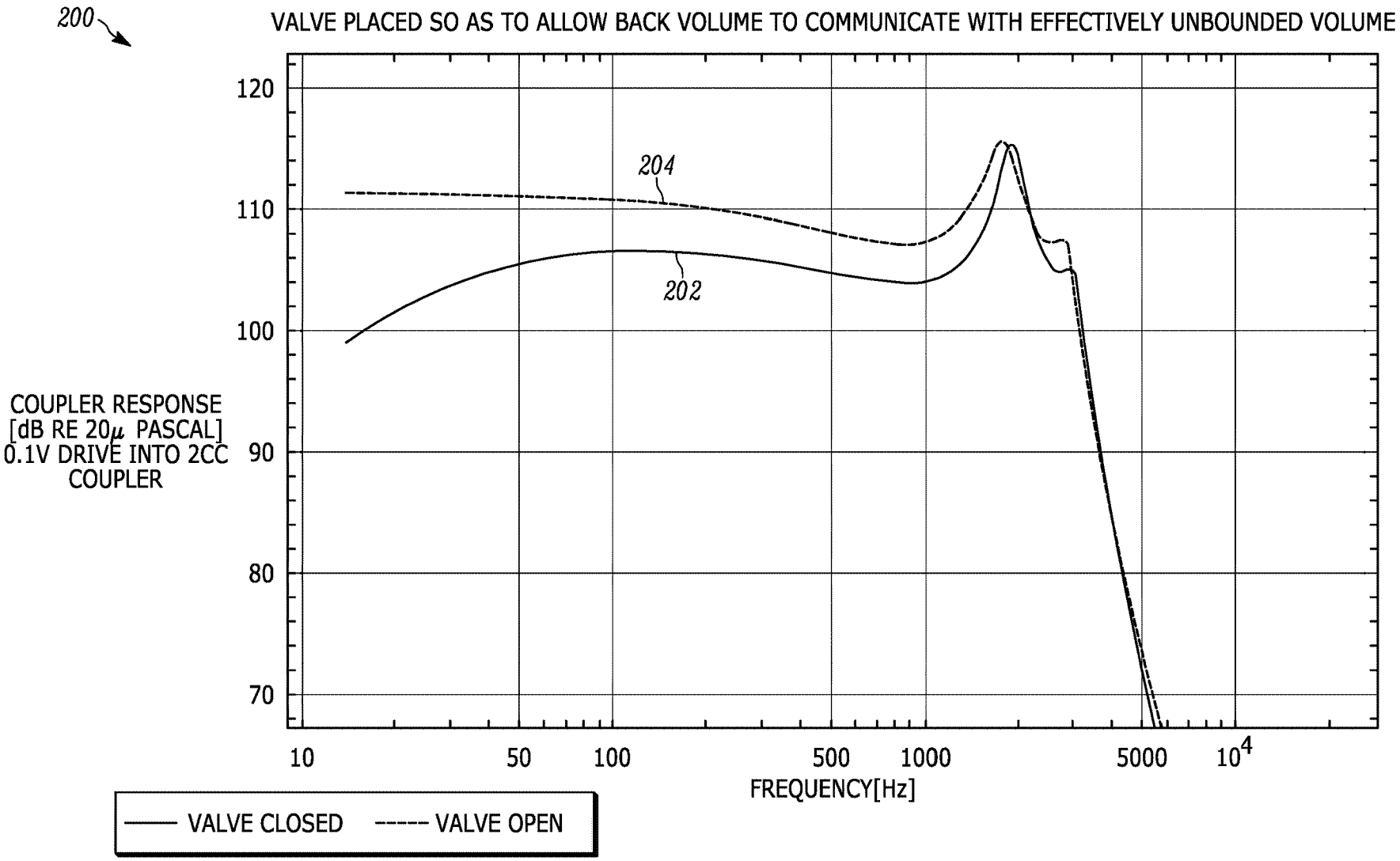
FIG. 2 is a graph showing the relationship between frequency and coupler response of the hearing device shown in FIG. 1 in different states.

FIG. 2 shows a graph 200 depicting the change in a coupler response of the valve configured to allow back volume to communicate with the effectively unbounded volume, one example of which is illustrated in FIG. 1. The graph 200 compares a response 202 when the valve is closed and another response 204 when the valve is open. In this example, the hearing device has a new resonant frequency when the valve is in the open state, where an acoustic output of the hearing device is increased at frequencies less than the new resonant frequency when the valve is in the open state.

Figure 3:
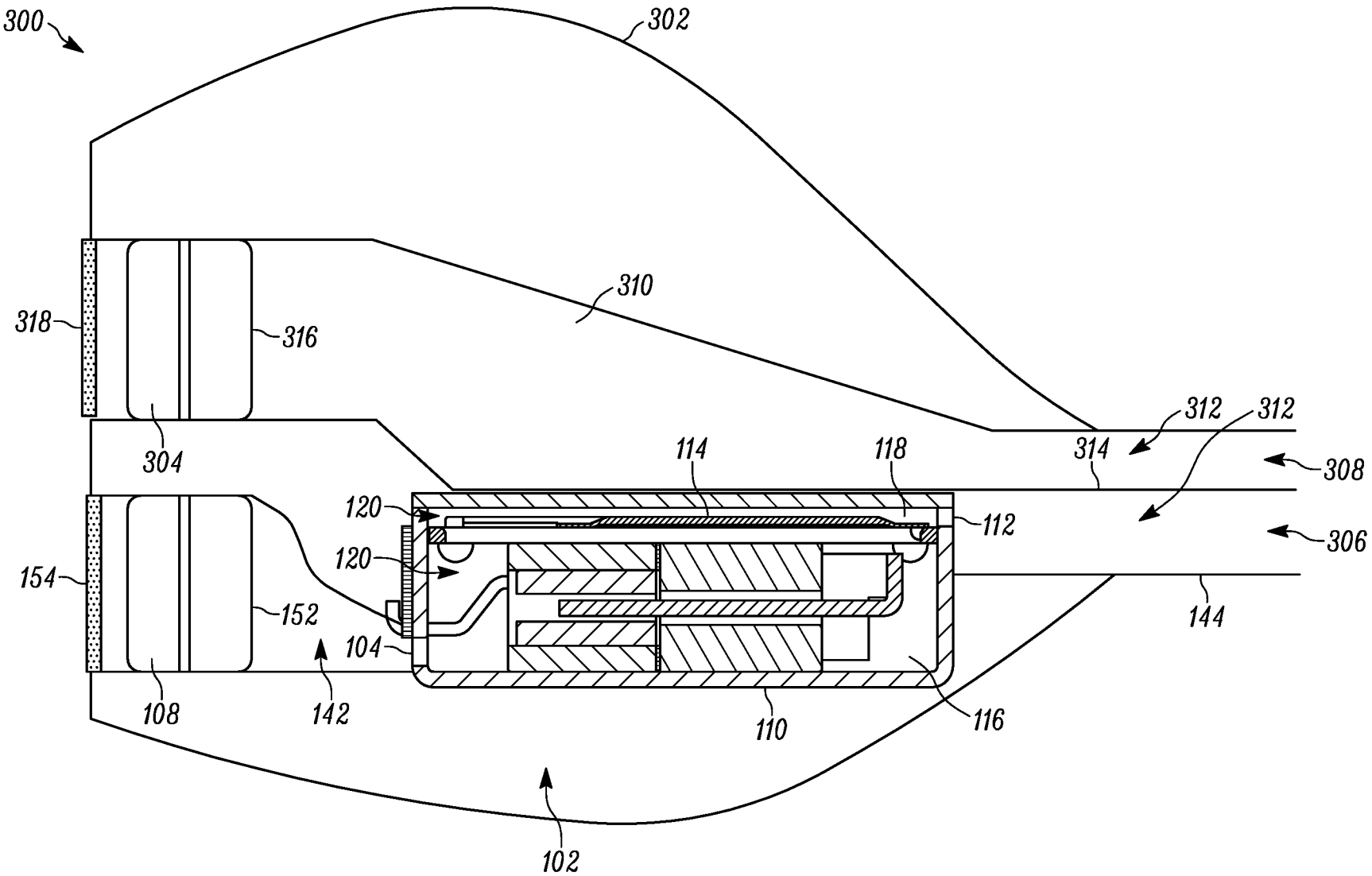
FIG. 3 is a schematic diagram illustrating a hearing device in accordance with one example set forth in the disclosure.

FIG. 3 illustrates one example of a hearing device 300 in which an acoustic valve is acoustically coupled to the back volume of an acoustic transducer via a vent port, the volume external to a transducer housing is an effectively unbounded volume external to a housing, and there is a second acoustic valve that is acoustically coupled to a vent path in the hearing device. The hearing device 300 is a hearing assembly which includes the acoustic transducer 102 with the vent port 104, a housing 302, and a second acoustic valve 304 in addition to the first acoustic valve 108.

In FIG. 3, the housing 302 includes a sound opening 306 and a vent opening 308 located inside the nozzle 144 of the housing 302 disposed in the user's ear. The sound opening 306 is acoustically coupled to the front volume 118 of the acoustic transducer 102, and sound produced by the acoustic transducer 102 emanates from the sound port 112 of the front volume 118 through the sound opening 306 of the housing 302 and into the user's ear. Similar to FIG. 1, when the acoustic valve 108 is in the open state, the back volume 116 of the acoustic transducer 102 is acoustically coupled to the effectively unbounded volume external to the housing 110, which is also the ambient atmosphere.

In this example, the second acoustic valve 304 is located in a vent path 310 which spans from inside the nozzle 144 to the other end of the housing 302 where the first acoustic valve 108 is disposed. Inside the nozzle 144 is a portion 312 disposed in the user's ear which is divided into the acoustic passage 142 and the vent path 310 by a partition 314 placed inside the nozzle 144. The second acoustic valve 304 also has a first port 316 coupled to the vent opening 308. Similar to the first acoustic valve 108, a sound transmissive contamination barrier 318 is placed in the vent path 310 between the second acoustic valve 304 and an effectively unbounded volume, or the ambient atmosphere, external to the housing 302, so that the barrier 318 acts as a filter which protects the second acoustic valve 304 and the vent opening 308 from contaminants such as dirt, dust, water, or other foreign substances which may enter the vent path 310 from the ambient atmosphere. As such, in this example, even when the first acoustic valve 108 is in the closed state, the user's ear can be vented and acoustically coupled to the effectively unbounded volume external to the housing 302, i.e. the ambient atmosphere, by actuating the second acoustic valve 304 into the open state.

When the valve 304 is open, the vent 310 reduces occlusion and passes ambient sounds through so that the user can hear the sounds from outside the hearing device. Furthermore, discomfort of inserting and extracting the hearing device is reduced when the acoustic valve is in the open state. When the valve 304 is closed, the vent 310 prevents the passage of ambient sounds and low frequency output is improved.

Figure 4:
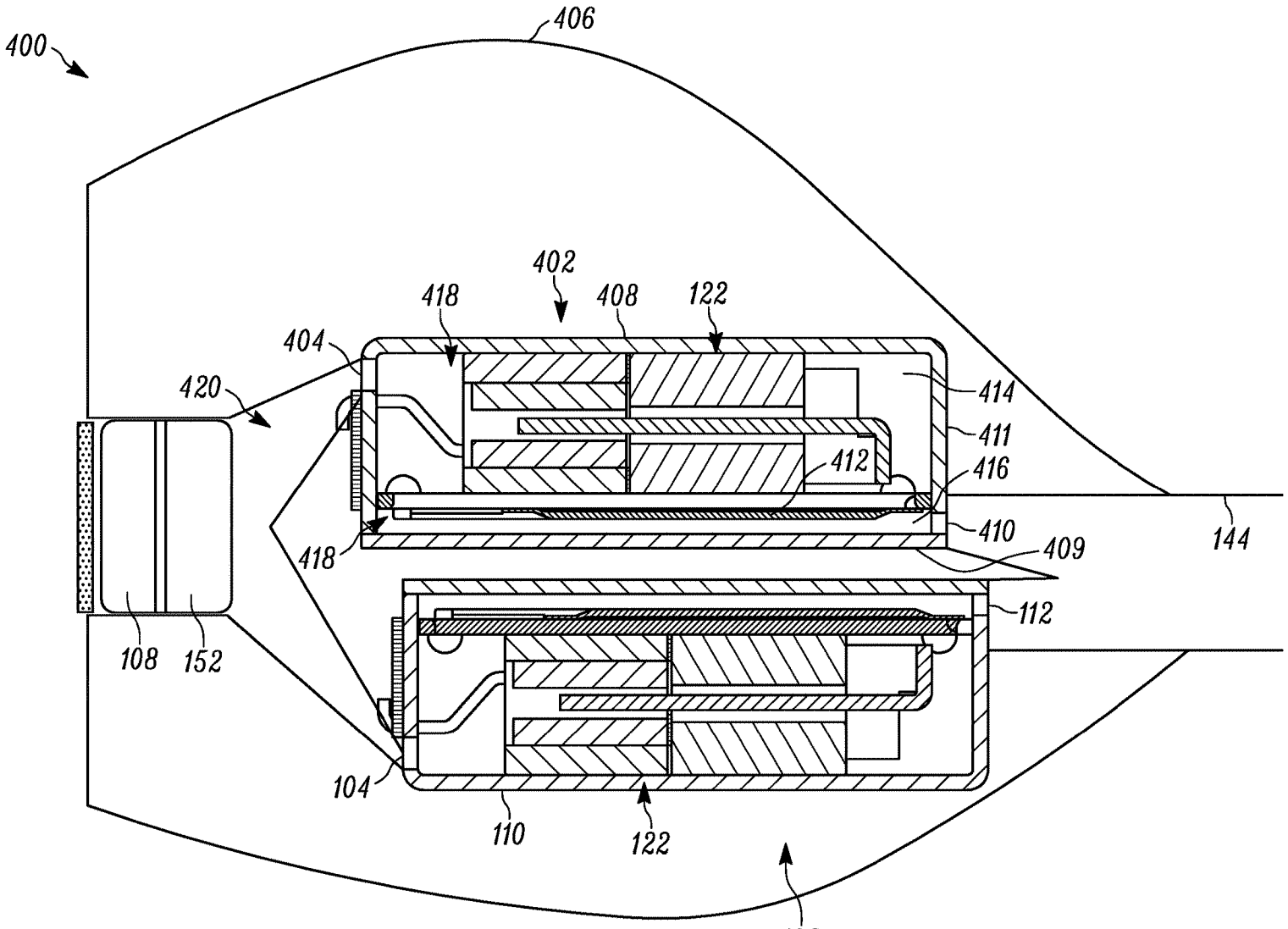
FIG. 4 is a schematic diagram illustrating a hearing device in accordance with one example set forth in the disclosure.

FIG. 4 illustrates one example of a hearing device 400 in which an acoustic valve is acoustically coupled to the back volume of two acoustic transducers via a vent port, wherein the volume external to a transducer housing is an effectively unbounded volume external to a housing. The hearing device 400 is a hearing assembly which includes the first acoustic transducer 102, a second acoustic transducer 402 with a vent port 404, a housing 406, and the acoustic valve 108.

The second acoustic transducer 402 in this example may be structurally similar to the first acoustic transducer 102, or it may be a different type of transducer. The first and second transducers increase the output of the hearing device in the same or in different frequency ranges. The second acoustic transducer 402 includes a transducer housing 408, a sound port 410 defined by a cover 409 and a cup 411 of the transducer housing 408, and a diaphragm 412 separating an internal volume 418 inside the transducer housing 408 into a back volume 414 and a front volume 416. The front volume 416 is acoustically coupled to the nozzle 144 of the housing 406, and the back volume 414, which is coupled to the vent port 404, is acoustically coupled to the acoustic valve 108 and the back volume of the first acoustic transducer 102. In this embodiment, the two acoustic transducers 102 and 402 are disposed such that the covers 111 and 409 are facing each other, and the distance between the two sound ports 112 and 410 is shorter than the distance between the two vent ports 104 and 404, thereby allowing for a smaller nozzle than is otherwise possible. An acoustic passage 422 connects the two vent ports 104 and 404 to the first port 152 of the acoustic valve 108.

Figure 5:
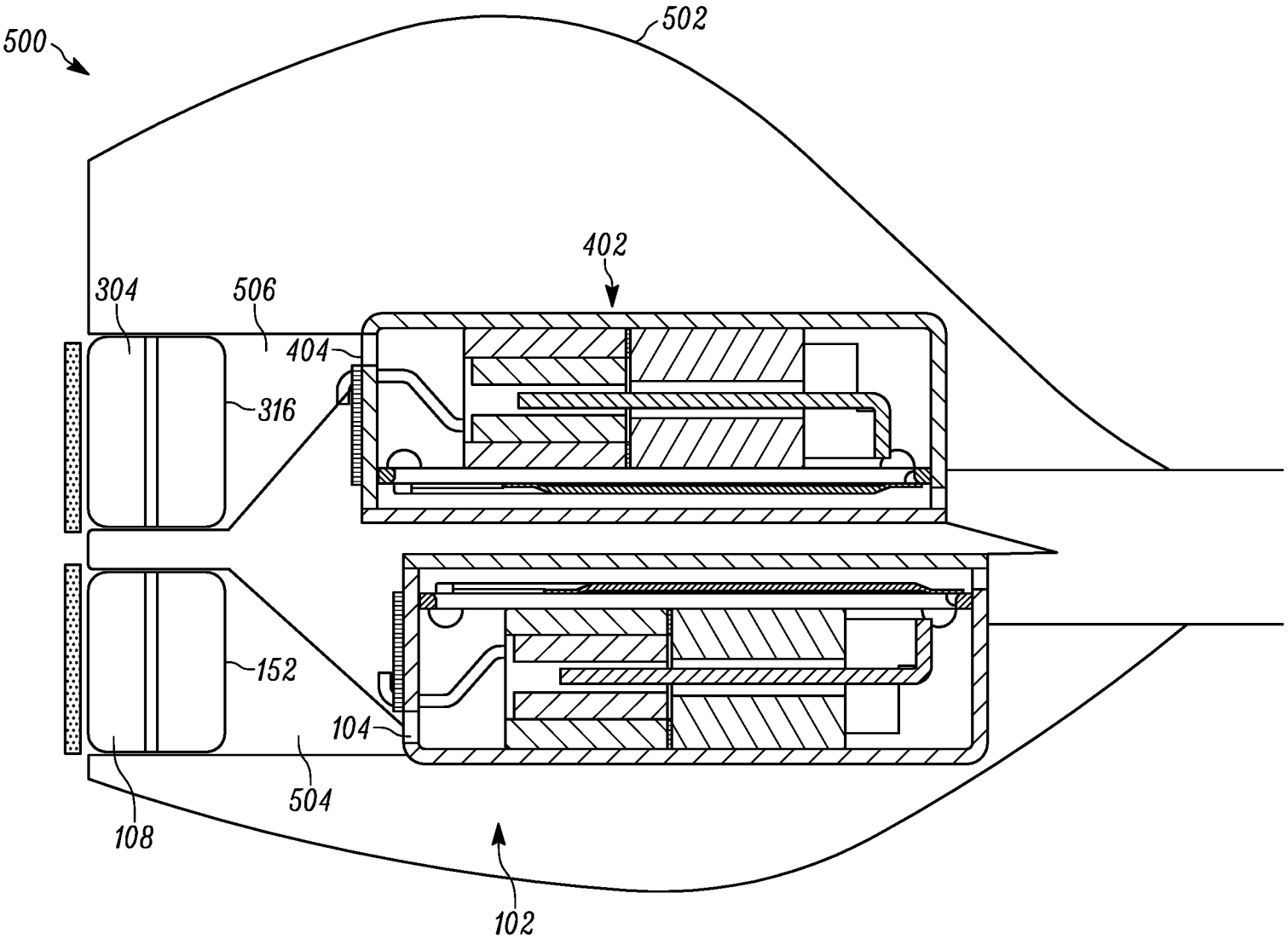
FIG. 5 is a schematic diagram illustrating a hearing device in accordance with one example set forth in the disclosure.

FIG. 5 illustrates one example of a hearing device 500 with two acoustic valves and two acoustic transducers, in which each acoustic valve is acoustically coupled to the back volume of a corresponding acoustic transducer via a vent port, wherein the volume external to a transducer housing is an effectively unbounded volume external to a housing. The hearing device 500 is a hearing assembly which includes the first acoustic transducer 102, the second acoustic transducer 402, a housing 502, the first acoustic valve 108, and the second acoustic valve 304.

The positions of the two acoustic transducers 102 and 402 are the same as the example shown in FIG. 4. However, instead of having the vent ports 104 and 404 acoustically coupled to the same acoustic valve 108, the first vent port 104 is acoustically coupled to the first port 152 of the first acoustic valve 108 and the second vent port 404 is acoustically coupled to the first port 316 of the second acoustic valve 304. A first acoustic passage 504 couples the first vent port 104 to the first acoustic valve 108, and a second acoustic passage 506 couples the second vent port 404 to the second acoustic valve 304. As such, in this example, there are two sets of acoustic transducers, acoustic passages, and acoustic valves.

Figure 6:
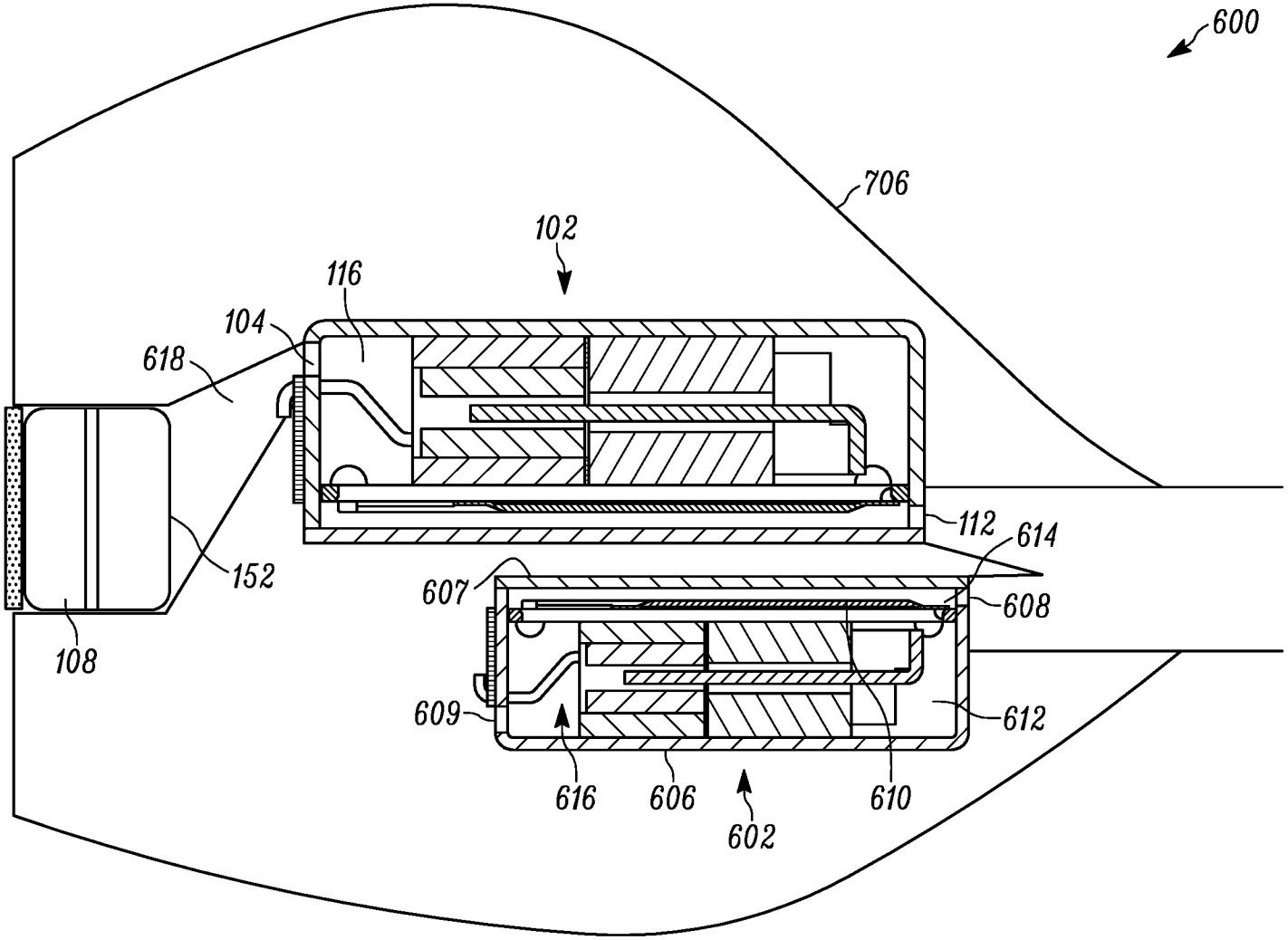
FIG. 6 is a schematic diagram illustrating a hearing device in accordance with one example set forth in the disclosure.

FIG. 6 illustrates one example of a hearing device 600 with two acoustic transducers of different sizes, in which only the larger of the two acoustic transducers is acoustically coupled to an acoustic valve via a vent port, the volume external to a transducer housing of the larger acoustic transducer is an effectively unbounded volume external to a housing. The hearing device 600 is a hearing assembly which includes the first acoustic transducer 102, a second acoustic transducer 602, a housing 604, and the acoustic valve 108.

When an acoustic transducer is larger in size, the bass response is greater than that of a smaller acoustic transducer. As such, the larger transducer, which in this example is the first acoustic transducer 102, is acoustically coupled to the first port 152 of the acoustic valve 108 so that when the acoustic valve 108 is actuated into the open position, the back volume 116 of the first acoustic transducer 102 is acoustically coupled to the effectively unbounded volume, or the ambient atmosphere, external to the housing 604. The smaller transducer in this example, which is the second acoustic transducer 602, includes a transducer housing 606, a sound port 608 defined by a cover 607 and a cup 609 of the transducer housing 606, a diaphragm 610 dividing the volume inside the transducer housing 606 into a back volume 612 and a front volume 614, and a motor 616 disposed in the back volume 612. In this example, an acoustic passage 618 acoustically couples the vent port 104, and therefore the back volume 116, of the first acoustic transducer 102 with the acoustic valve 108. The back volume 612 of the second transducer, on the other hand, does not have a vent port and therefore is not acoustically coupled to the acoustic valve 108.

Figure 7:
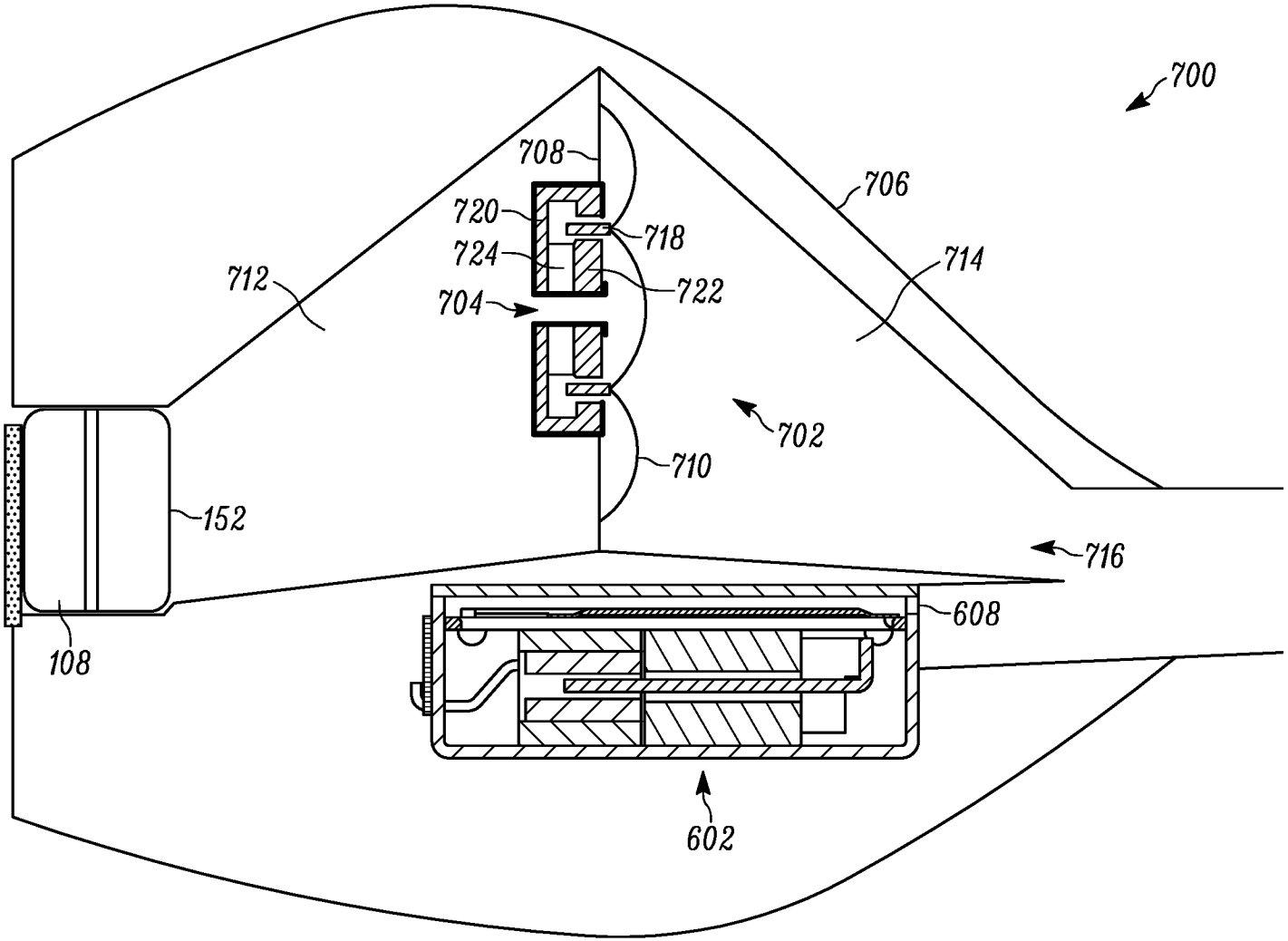
FIG. 7 is a schematic diagram illustrating a hearing device in accordance with one example set forth in the disclosure.

FIG. 7 illustrates one example of a hearing device 700 in which the larger acoustic transducer, which was embodied as a balanced armature receiver in the example shown in FIG. 6, is replaced with a dynamic speaker 702. The hearing device 700 includes a dynamic speaker 702, the smaller acoustic transducer 602, a housing 706, and the acoustic valve 108. The dynamic speaker 702 has a vent port 704 acoustically coupled to the first port 152 of the acoustic valve 108, a transducer housing 708, a diaphragm 710 separating the an internal volume of the housing 706 into a back volume 712 and a front volume 714, where a sound port 716 is coupled to the front volume 714 and to the user's ear. The transducer housing 708 is at least partially defined by a portion of the housing 706, which defines the sound port 716. The dynamic speaker 702 includes an annular voice coil 718 fixing the diaphragm 710 so that the voice coil 718 is held between portions 720 and 722 of a magnetic material, both of which is attached to a permanent magnet 724. In other embodiments, other types of speakers may be used.

Figure 8:
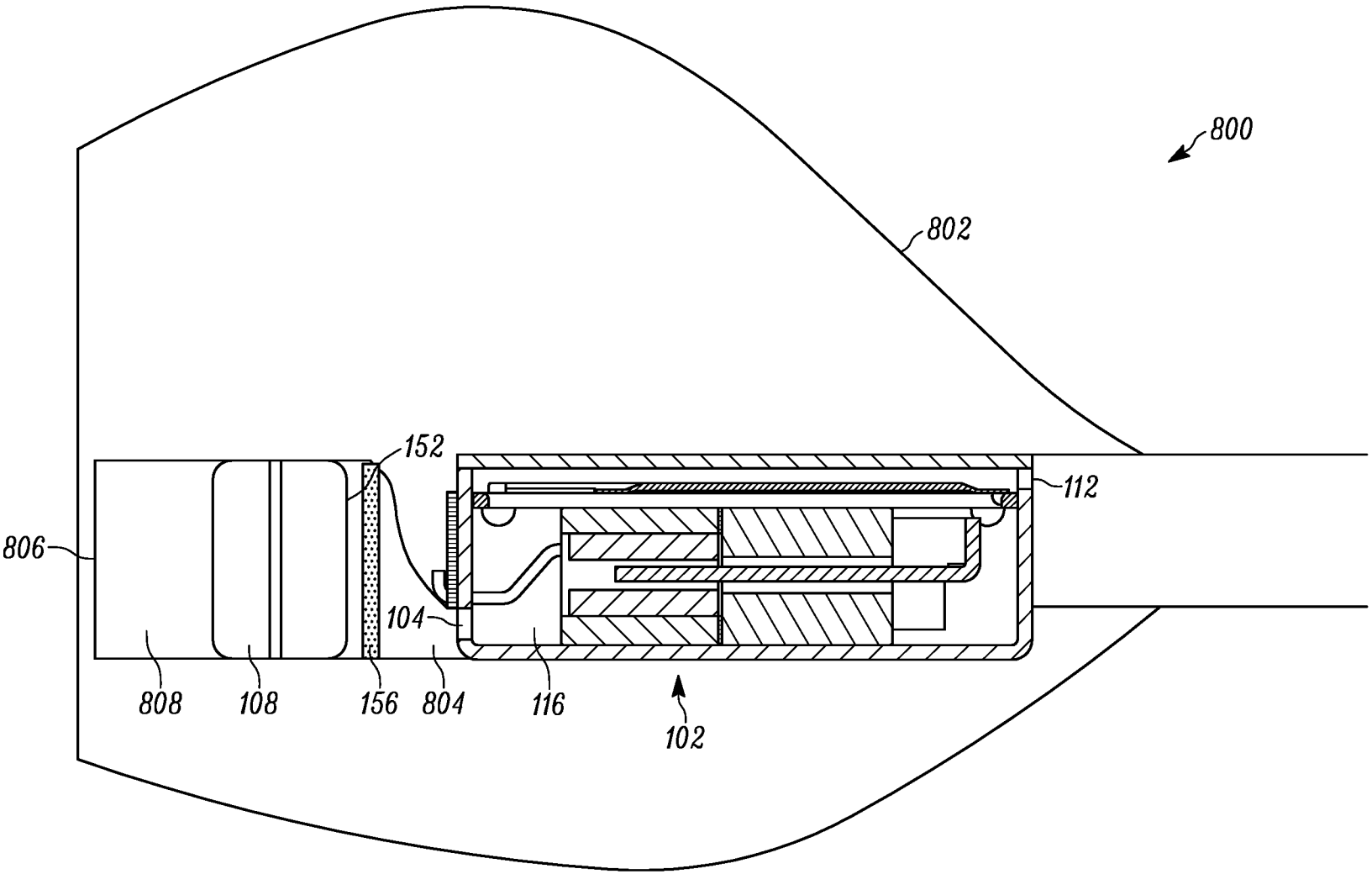
FIG. 8 is a schematic diagram illustrating a hearing device in accordance with one example set forth in the disclosure.

FIG. 8 illustrates one example of a hearing device 800 in which an acoustic valve is acoustically coupled to the back volume of an acoustic transducer via a vent port, wherein the volume external to a transducer housing is a closed cavity located inside a housing. In this example, the hearing device 800 includes the acoustic transducer 102, a housing 802, and the acoustic valve 108. The hearing device 800 differs from the previously illustrated examples of hearing devices in that the housing 802 has no opening which allows the acoustic valve 108 to be coupled to the effectively unbounded volume external to the housing, or the ambient atmosphere, when the hearing device 108 is at least partially inserted into the user's ear. Therefore, the housing 802 includes the acoustic transducer 102 with the sound port 112 acoustically coupled to the user's ear, an acoustic passage 804 leading from the vent port 104 of the acoustic transducer 102 to the first port 152 of the acoustic valve 108, and a closed cavity 806 internal to the housing 802 which defines a larger unvented back volume 808 for the acoustic transducer 102 when the acoustic valve 108 is actuated to the open state. In this example, when the acoustic valve 108 is in the open state, the back volume 116 of the acoustic transducer 102 is effectively expanded to also include the volume defined by the closed cavity 806, thereby resulting in a response that resembles a device with a larger back volume. The acoustic passage 804 also includes a damper 156 to smooth or otherwise shape the frequency response of the hearing device 800.

Figure 9:
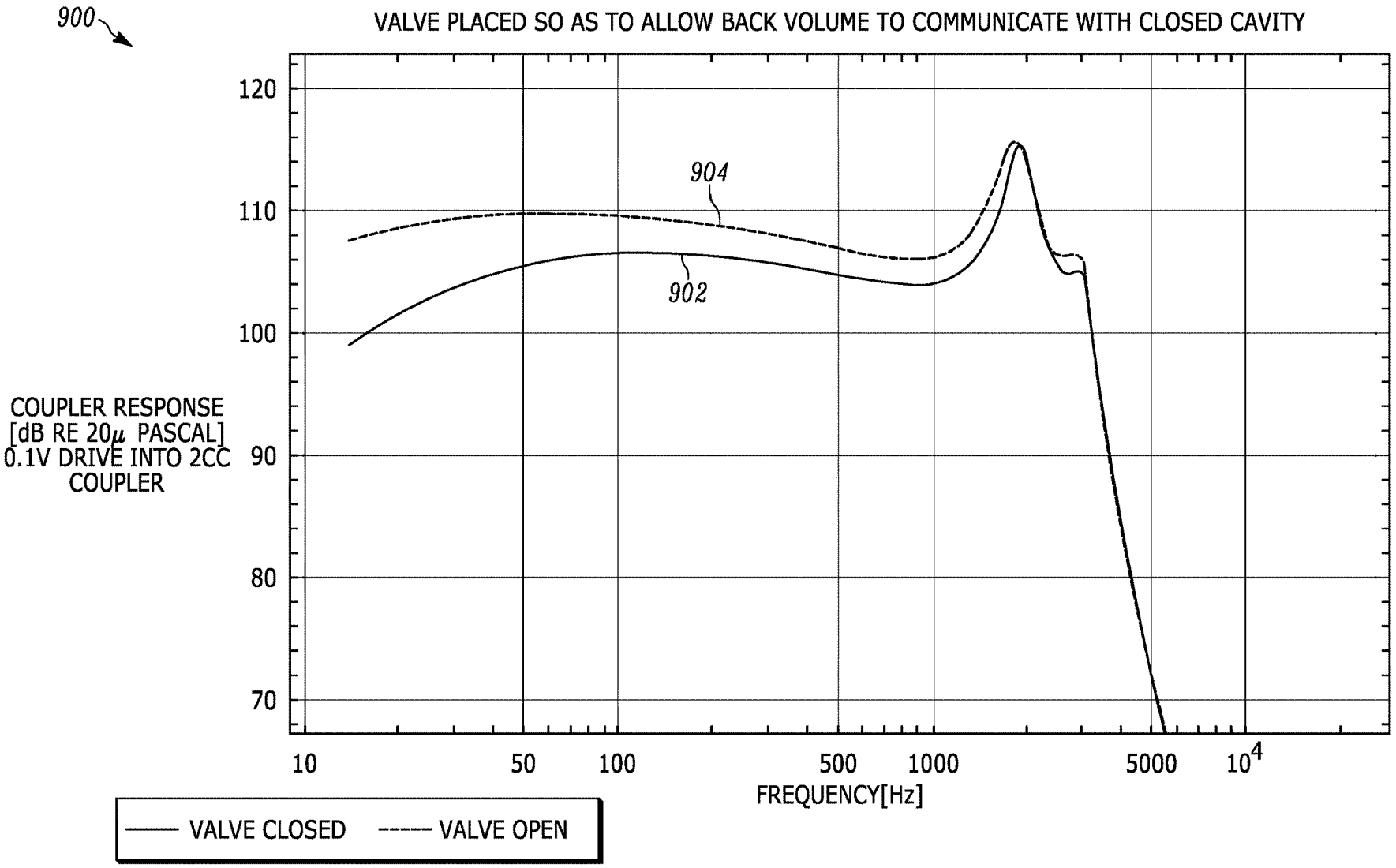
FIG. 9 is a graph showing the relationship between frequency and coupler response of the hearing device shown in FIG. 8, in open and closed states.

FIG. 9 shows a graph 900 depicting the change in a coupler response of the valve placed so as to allow back volume to communicate with a closed cavity, one example of which is illustrated in FIG. 8. The graph 900 compares a response 902 when the valve is closed and another response 904 when the valve is open. In this example, the hearing device has a new resonant frequency when the valve is in the open state, where an acoustic output of the hearing device is increased at frequencies less than the new resonant frequency when the valve is in the open state.

Figure 10:
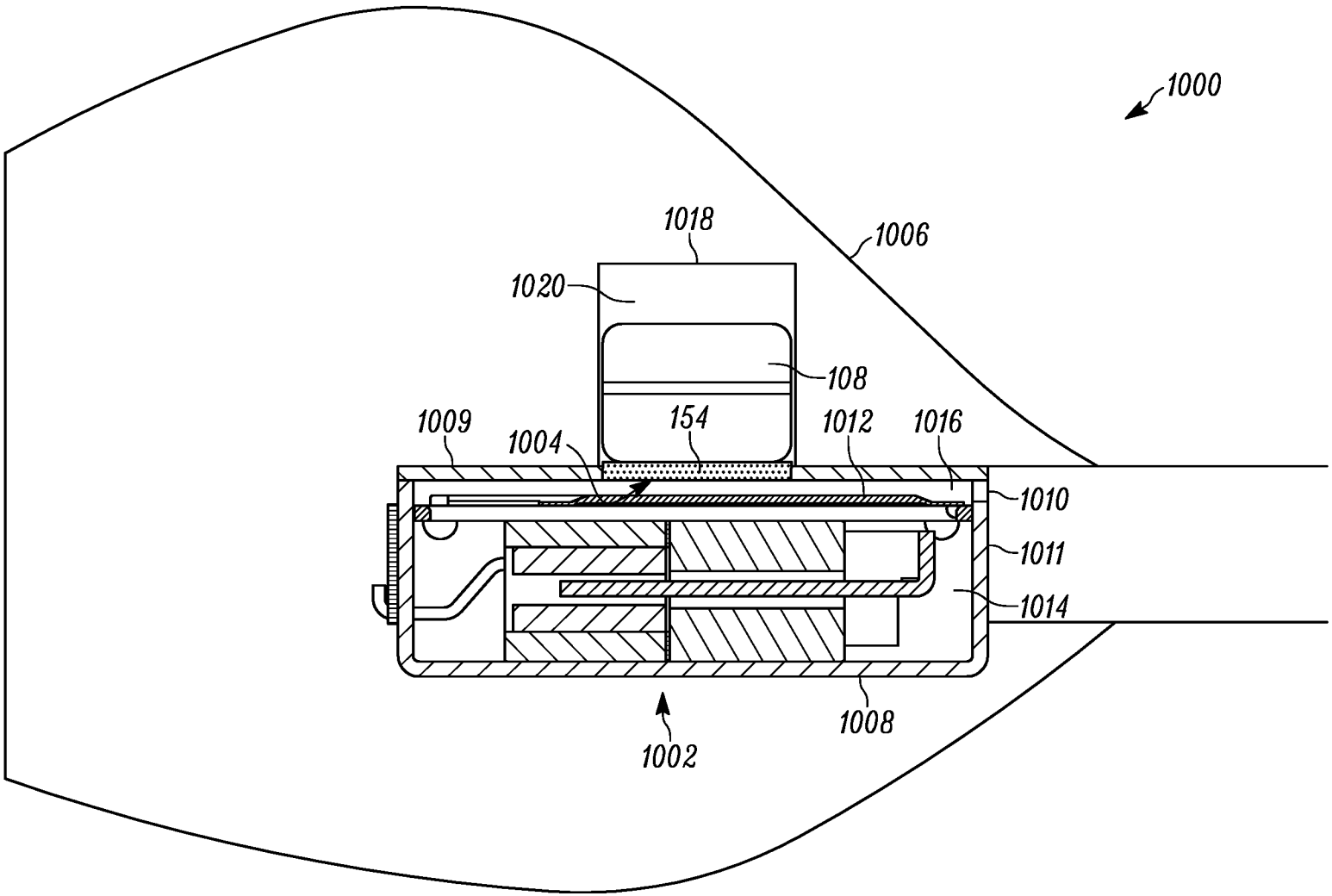
FIG. 10 is a schematic diagram illustrating a hearing device in accordance with one example set forth in the disclosure.

FIG. 10 illustrates one example of a hearing device 1000 in which an acoustic valve is acoustically coupled to the front volume of an acoustic transducer via a vent port, and the volume external to a transducer housing is a closed cavity located inside a housing. In this example, the hearing device 1000 includes an acoustic transducer 1002 with a vent port 1004, a housing 1006, and the acoustic valve 108. The housing 1006 includes the acoustic transducer 1002 with the sound port 1010 defined by a cover 1009 and a cup 1011 of the transducer housing 1008. The sound port 1010 is acoustically coupled to the user's ear. The vent port 1004 is defined by the cover 1009. A diaphragm 1012 of the acoustic transducer 1002 divides a volume inside the transducer housing 1008 into a back volume 1014 and a front volume 1016. The housing 1006 also includes a closed cavity 1018 internal to the housing 1006 which is coupled to the front volume 1020 when the acoustic valve 108 is actuated to the open state, thereby resulting in a response that resembles a device with a larger front volume.

In this example, the closed cavity 1018 is located perpendicularly with respect to the cover 1009 of the transducer housing 1008, however any other suitable configuration for the closed cavity 1018 may be employed. In this example, when the acoustic valve 108 is in the open state, the front volume 1016 of the acoustic transducer 1002 is effectively expanded to also include the volume defined by the closed cavity 1018. The vent port 1004 includes a damper 156 to smooth or otherwise shape the frequency response of the hearing device 1000.

Figure 11:
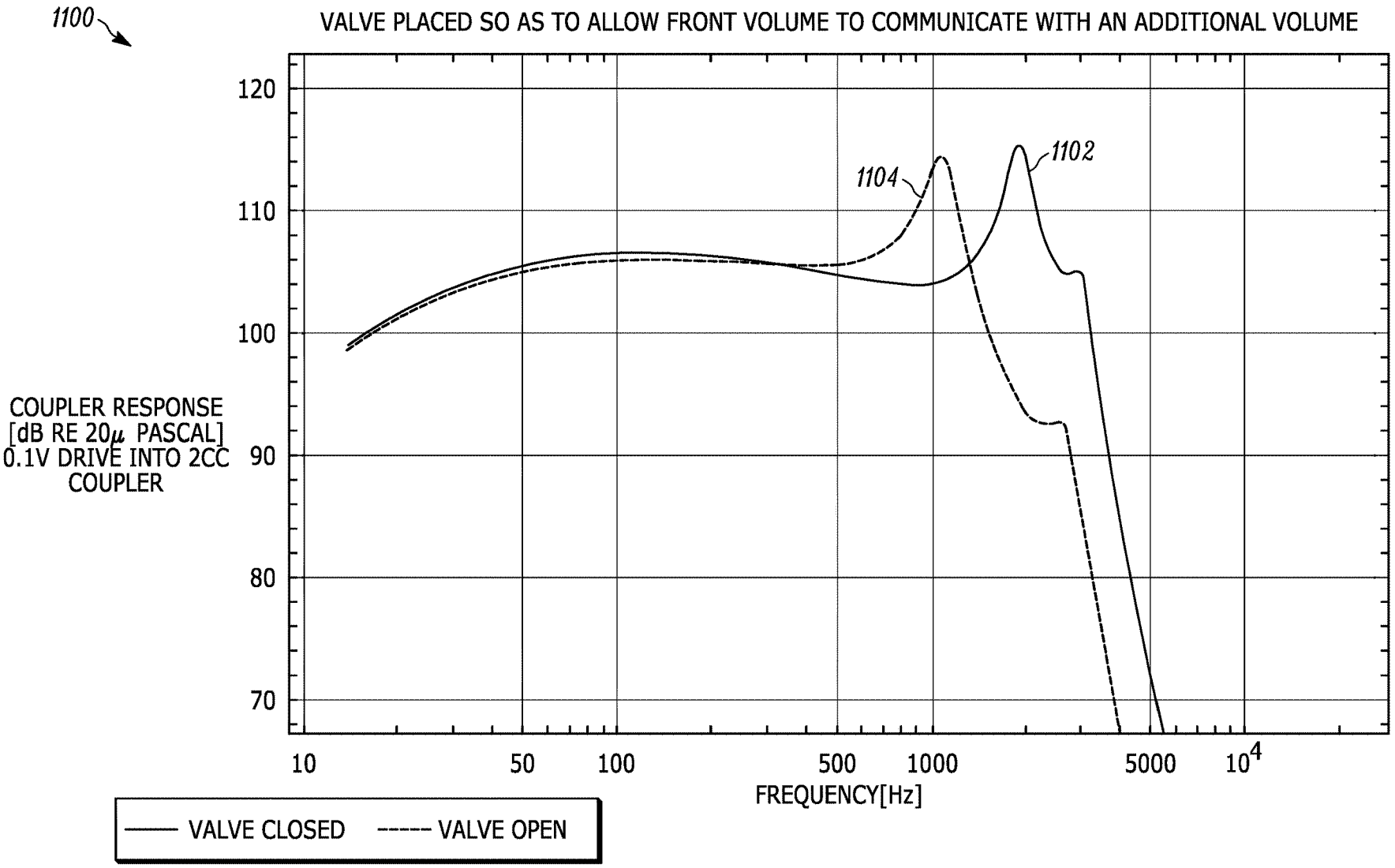
FIG. 11 is a graph showing the relationship between frequency and coupler response of the hearing device shown in FIG. 10, in open and closed states.

FIG. 11 shows a graph 1100 depicting the change in a coupler response of the valve placed so as to allow front volume to communicate with an additional closed volume inside the housing, one example of which is illustrated in FIG. 10. The graph 1100 compares a response 1102 when the valve is closed and another response 1104 when the valve is open. In this example, the hearing device has a resonant frequency when the valve is in the closed state. The resonant frequency is decreased when the valve is in the open state, and an acoustic output of the hearing device is decreased at frequencies higher than the new resonant frequency when the valve is in the open state.

Coupling the front volume to a closed cavity inside the housing lowers the resonant frequency and produces increased output in a band of frequencies about the new resonant frequency. The closed volume also prevents contaminants such as dirt, dust, water, or any foreign substance from entering the acoustic passage, thereby eliminating the need for a filter. The closed volume in this case reduces dramatic decreases in output in certain frequency ranges and prevents leakage of sound to the ambient space that might be sensed by microphones that are placed on or near the hearing device.

Figure 12:
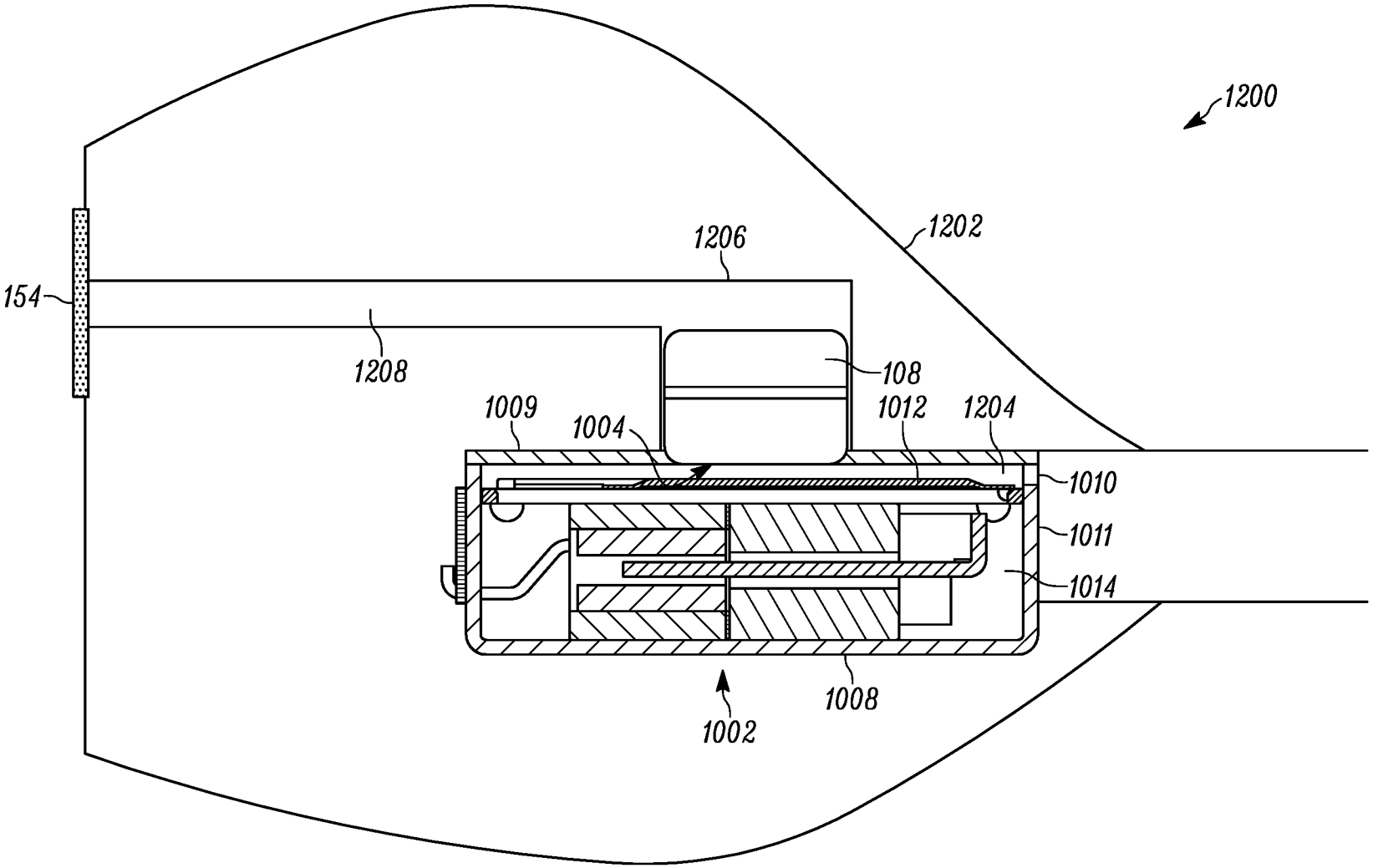
FIG. 12 is a schematic diagram illustrating a hearing device in accordance with one example set forth in the disclosure.

FIG. 12 illustrates one example of a hearing device 1200 in which an acoustic valve is acoustically coupled to the front volume of an acoustic transducer via a vent port, and the volume external to a transducer housing is an effectively unbounded volume external to the housing, or the ambient atmosphere. In this example, the hearing device 1200 includes the acoustic transducer 1002, a housing 1202, and the acoustic valve 108. The housing 1202 includes the acoustic transducer 1002 with the sound port 1010 defined by the cover 1009 and the cup 1011 of the transducer housing 1008. The vent port 1004 is defined by the cover 1009. A diaphragm 1012 of the acoustic transducer 1002 divides a volume inside the transducer housing 1008 into the back volume 1014 and a front volume 1204. The housing 1202 also includes an acoustic passage 1206 in which the acoustic valve 108 is disposed. The acoustic passage 1206 defines a larger vented front volume 1208 for the acoustic transducer 1002 when the acoustic valve 108 is in the open state. As such, when the acoustic valve 108 is in the open state, the front volume 1204 is expanded to include the larger vented front volume 1208, which is acoustically coupled to the effectively unbounded volume external to the housing, or the ambient atmosphere. The barrier 154 is additionally attached to the housing 1202.

Figure 13:
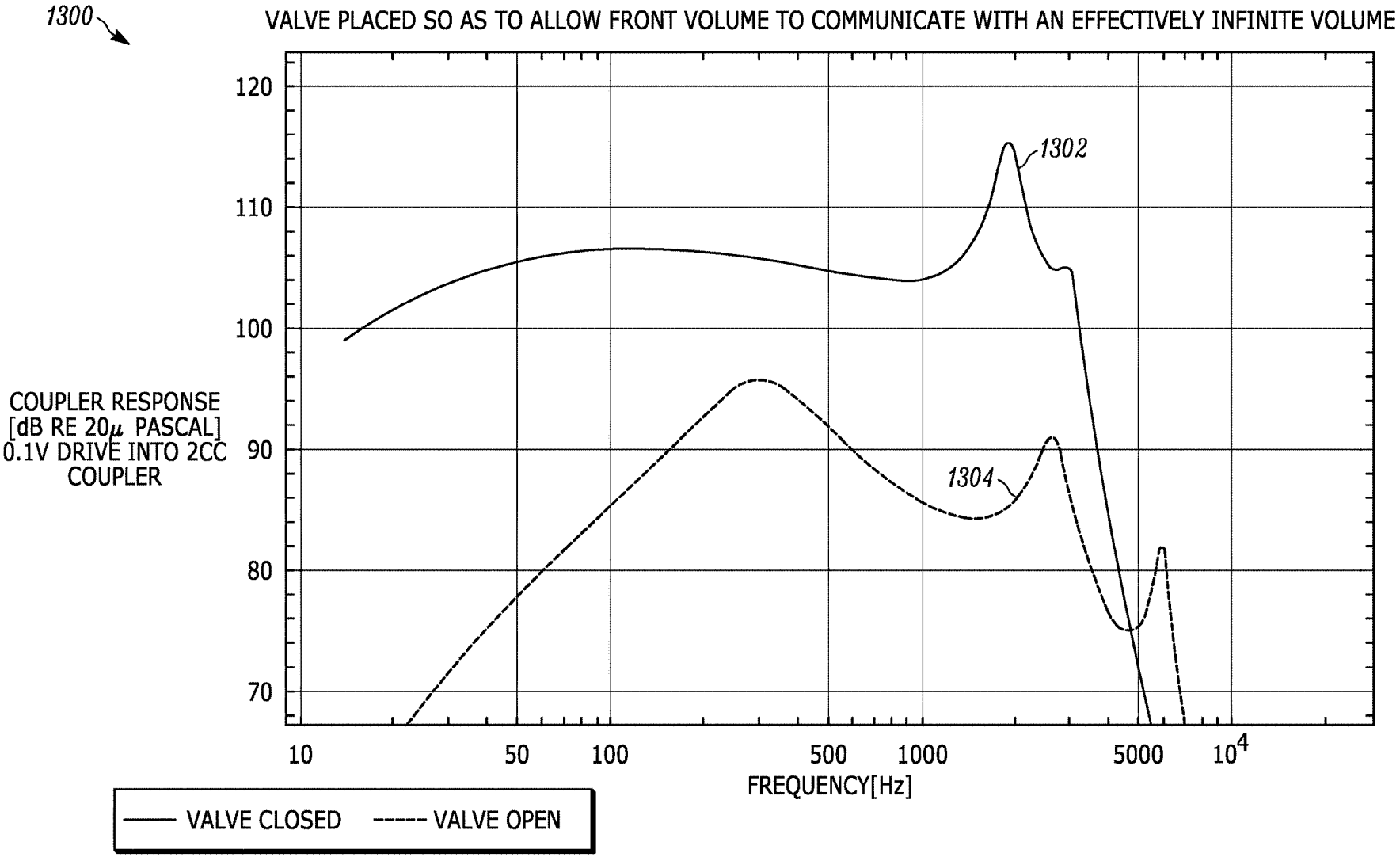
FIG. 13 is a graph showing the relationship between frequency and coupler response of the hearing device shown in FIG. 12, in open and closed states.

FIG. 13 shows a graph 1300 depicting the change in a coupler response of the valve placed so as to allow front volume to communicate with effectively unbounded volume, one example of which is illustrated in FIG. 12. The graph 1300 compares a response 1302 when the valve is closed and another response 1304 when the valve is open. This example enables pass through of externally produced sounds, reduced occlusion for the user, and reduced acoustic output of the hearing device over a wide range of frequencies when the valve is in the open state. For example, the valve may be closed for listening to music and open when the user wishes to verbally communicate with a companion.

Figure 14:
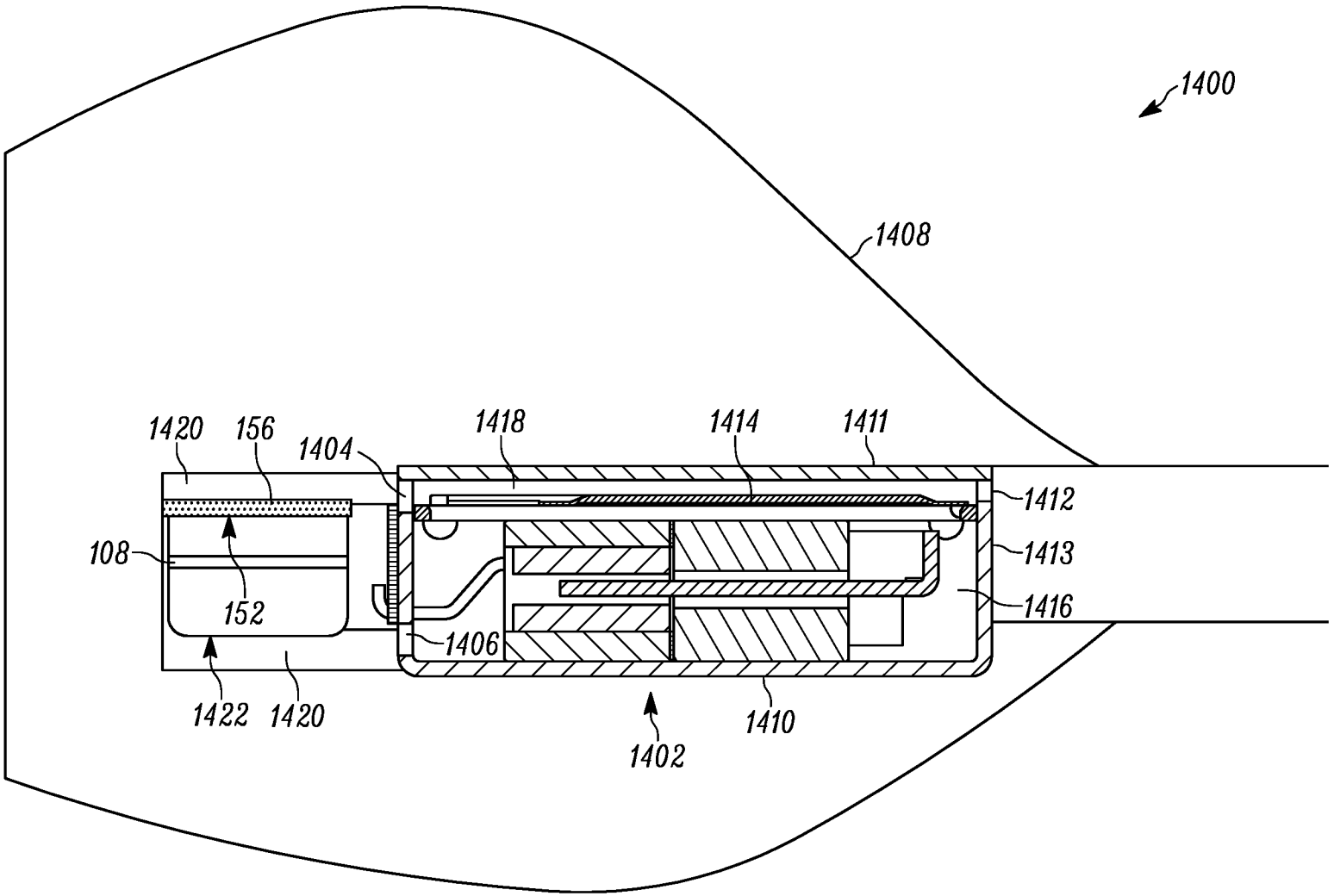
FIG. 14 is a schematic diagram illustrating a hearing device in accordance with one example set forth in the disclosure.

FIG. 14 illustrates one example of a hearing device 1400 in which an acoustic valve is acoustically coupled to the front volume and the back volume of an acoustic transducer via two vent ports, and the volume external to a transducer housing is a closed cavity located inside the housing. In this example, the hearing device 1400 includes the acoustic transducer 1402 with a first vent port 1404 and a second vent port 1406, a housing 1408, and the acoustic valve 108. The acoustic transducer 1402 includes a transducer housing 1410, a sound port 1412 defined by a cover 1411 and a cup 1413 of the transducer housing 1410, and a diaphragm 1414 which divides a volume inside the transducer housing 1410 into a back volume 1416 and a front volume 1418. The front volume 1418 is coupled to the first vent port 1404, and the back volume 1416 is coupled to the second vent port 1406. The two vent ports 1404 and 1406 are defined by the transducer housing 1410 and connected to each other by an acoustic passage 1420 defined by the housing 1408, where the acoustic valve 108 is disposed. The first port 152 of the acoustic valve 108 is coupled to the first vent port 1404, and the second port 1422 of the acoustic valve 108 is coupled to the second vent port 1406. The acoustic valve 108 also includes a damper 156 located by either the first port 152 or the second port 1422 to smooth or otherwise shape the frequency response of the hearing device 1400. One of the advantages of this example is that when the acoustic valve 108 is actuated to the open state, the acoustic valve 108 can act as a high pass filter.

Figure 15:
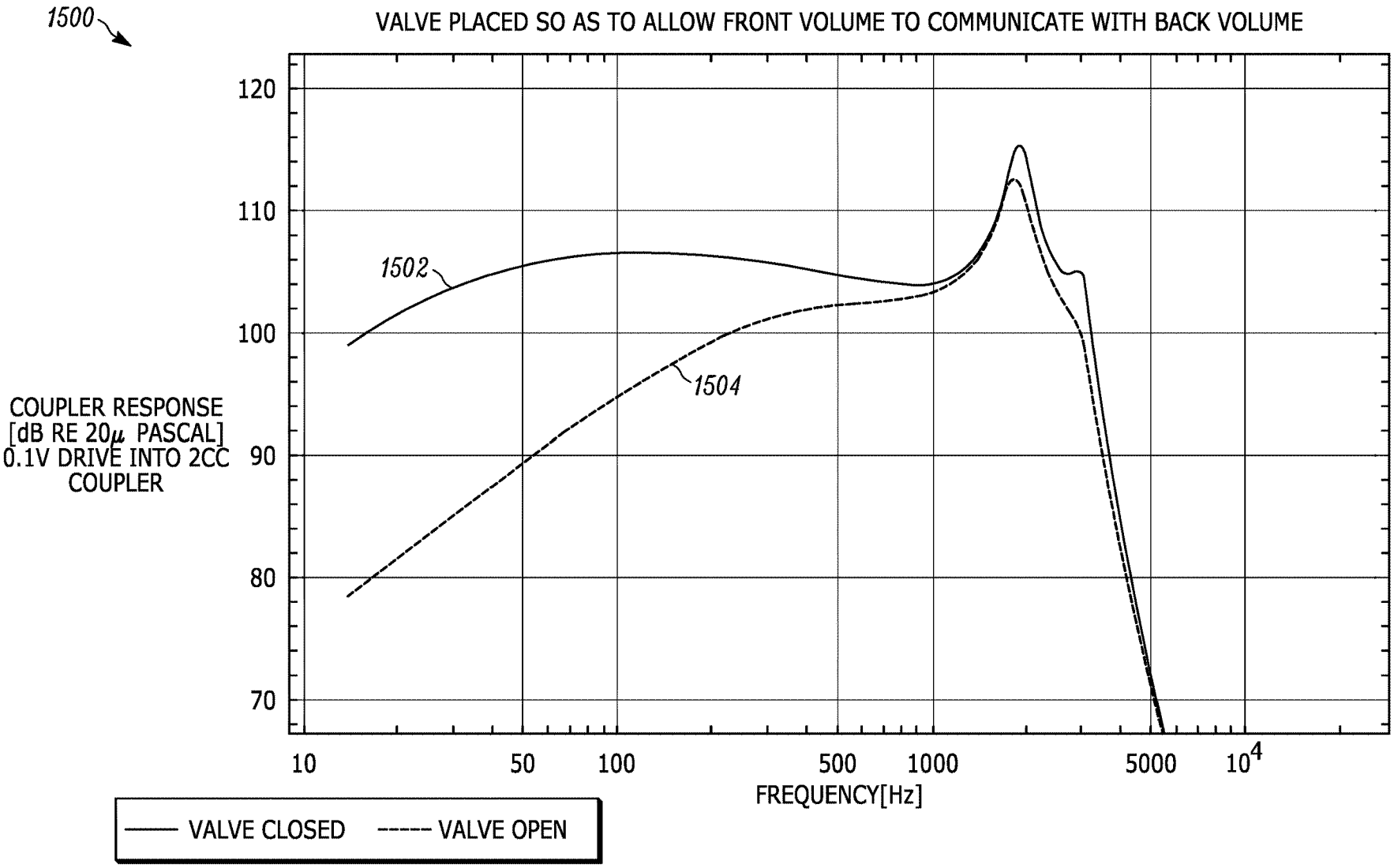
FIG. 15 is a graph showing the relationship between frequency and coupler response of the hearing device shown in FIG. 14, in open and closed states.

FIG. 15 shows a graph 1500 depicting the change in a coupler response of the valve placed so as to allow front volume to communicate with back volume, one example of which is illustrated in FIG. 14. The graph 1500 compares a response 1502 when the valve is closed and another response 1504 when the valve is open.

Figure 16:
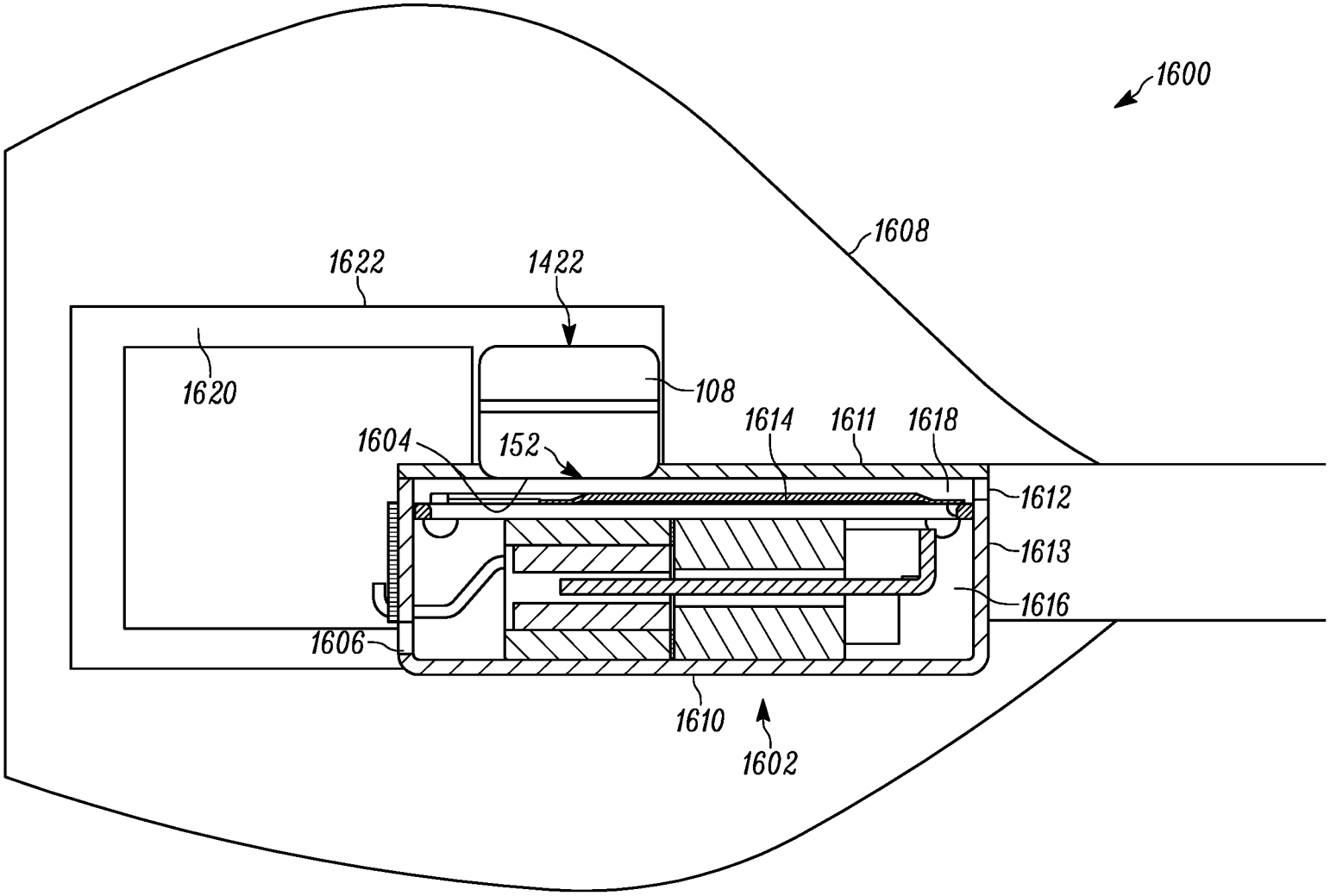
FIG. 16 is a schematic diagram illustrating a hearing device in accordance with one example set forth in the disclosure.

FIG. 16 illustrates one example of a hearing device 1600 in which an acoustic valve is acoustically coupled to the front and back volumes of an acoustic transducer via two vent ports, the volume external to a transducer housing is a closed volume located inside the housing defined by a long tube. In this example, the hearing device 1600 includes an acoustic transducer 1602 with a first vent port 1604 and a second vent port 1606, a housing 1608, and the acoustic valve 108. The acoustic transducer 1602 includes a transducer housing 1610, a sound port 1612 defined by a cover 1611 and a cup 1613 of the transducer housing 1610, and a diaphragm 1614 which divides a volume inside the transducer housing 1610 into a back volume 1616 and a front volume 1618. The front volume 1618 is coupled to the first vent port 1604, and the back volume 1616 is coupled to the second vent port 1606. The two vent ports 1604 and 1606 are defined by the transducer housing 1610 and connected to each other by an acoustic passage 1620 defined by a long tube 1622 in which the acoustic valve 108 is disposed. The long tube 1622 may be made of any suitable material including but not limited to plastic and metal, and the long tube 1622 may be part of the housing 1608 or implemented as a separate component, as appropriate. The first port 152 of the acoustic valve 108 is coupled to the first vent port 1604, and the second port 1422 of the acoustic valve 108 is coupled to the second vent port 1606. One of the advantages of this example is that the hearing device 1600 gets a second resonance by utilizing the long tube in forming the acoustic passage thereby increasing acoustic output at frequencies about the second resonance.

Figure 17:
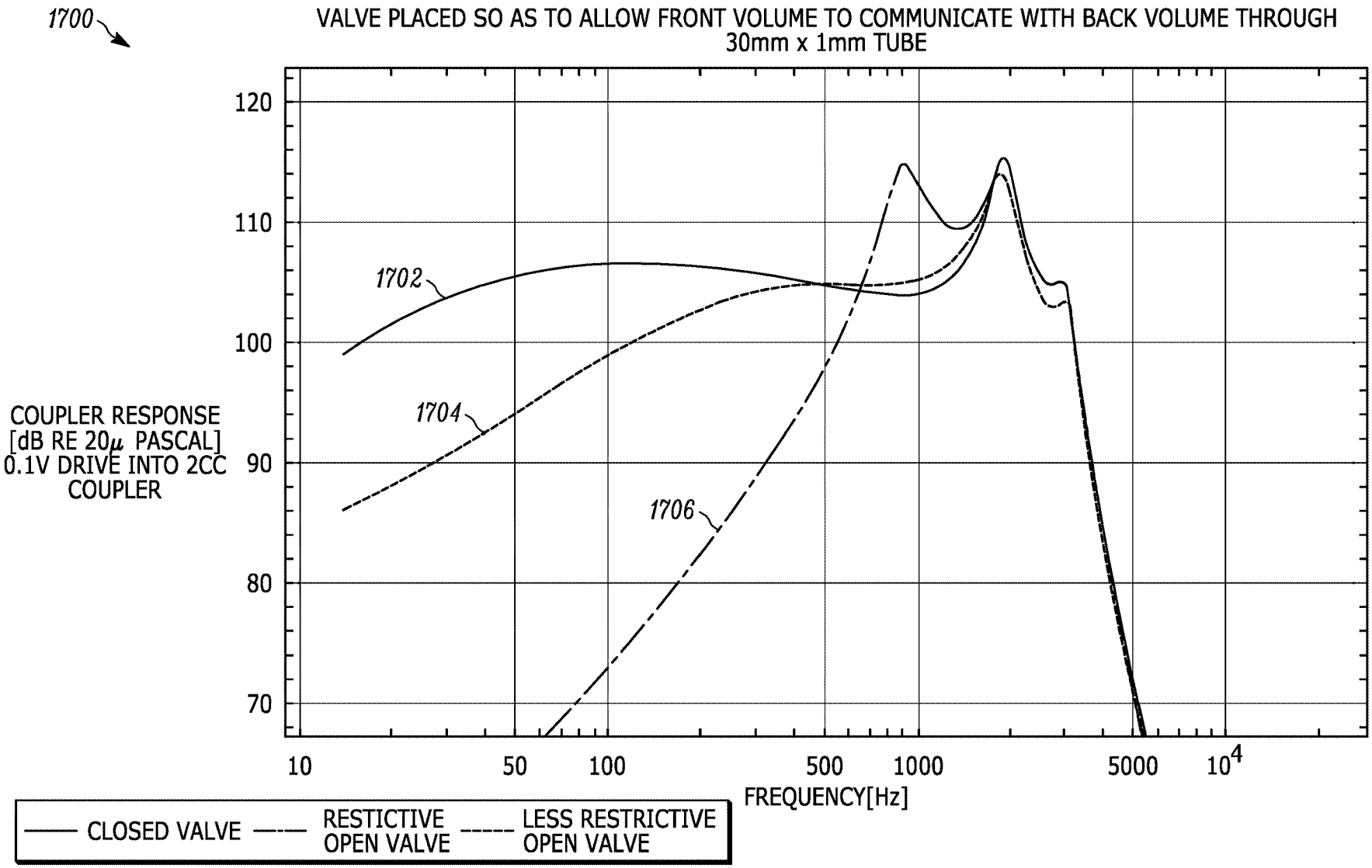
FIG. 17 is a graph showing the relationship between frequency and coupler response of the hearing device shown in FIG. 16, in closed, restrictively open, and less restrictively open states.

FIG. 17 shows a graph 1700 depicting the change in a coupler response of the valve placed so as to allow front volume to communicate with back volume through a tube with an inner diameter of 1 millimeter and a length of 30 millimeters, one example of which is illustrated in FIG. 16. The graph 1700 compares a response 1702 when the valve is closed, a response 1704 when the valve is in a restrictive open state, and another response 1706 when the valve is in a less restrictive open state. Advantages for having these different restrictive open states include using the restrictive open state of the valve as a high pass filter and using the less restrictive open state of the valve to reduce music bass and increase speech intelligibility. The device may be configured to have three separate states or just two of the states shown in FIG. 17.

Figure 18:
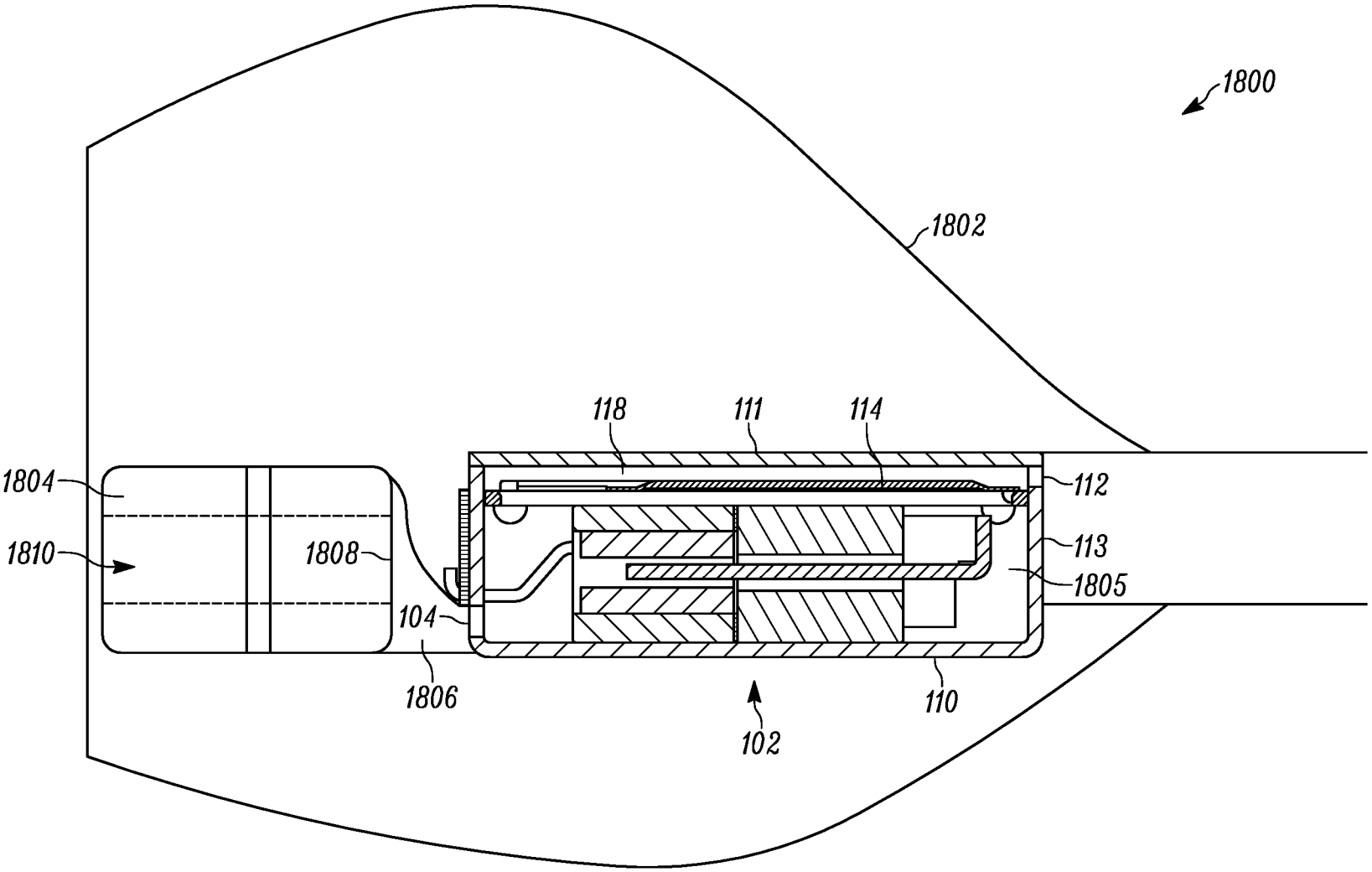
FIG. 18 is a schematic diagram illustrating a hearing device in accordance with one example set forth in the disclosure.

FIG. 18 illustrates one example of a hearing device 1800 in which an acoustic valve is acoustically coupled to the back volume of an acoustic transducer via a vent port, and the volume external to a transducer housing is a closed volume integral to the acoustic valve. In this example, the hearing device 1800 includes the acoustic transducer 102, a housing 1802, and an acoustic valve 1804. The diaphragm 114 divides a volume inside the transducer housing 110 into a back volume 1805 and the front volume 118, with the front volume 118 acoustically coupled to the sound port 112 defined by the cover 111 and the cup 113, and the back volume 1805 acoustically coupled to the vent port 104 defined by the cup 113. The vent port 104 is acoustically coupled to a first port 1808 of the acoustic valve 1804 through an acoustic passage 1806. In this example, a volume 1810 inside the acoustic valve 1804 is coupled to the back volume 1805 when the acoustic valve 1804 is in the open state.

Use of a valve with a large internal cavity in lieu of a separate cavity within the hearing device is not limited to embodiments where the valve is coupled to a back volume. In FIG. 18, the valve 1804 is coupled to the back volume 1805 and produces a similar result as the acoustic device of FIG. 8 where the valve 108 is coupled to the back volume 116 and an internal volume 808 of the cavity 806. In FIG. 10, for example, the front volume 1016 may be coupled to a large internal cavity of an acoustic valve instead of the volume 1020 of cavity 1018.

When the user prefers to change the acoustic characteristic of the hearing device, the acoustic valve included in the hearing device can be opened mechanically or electronically. If an electronic valve is employed, the opening and closing of the valve can be controlled by a variety of means including but not limited to user input to the hearing device, user input to a remote device, user input to a wired device, and decisions by algorithm in the device or in a connected device based on how the device is used. The connected device may be connected via a wire or may be wirelessly connected.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

The invention claimed is:

1. A hearing device comprising:

a rigid housing having a sound opening;

a sound-producing electroacoustic transducer disposed within the rigid housing, the transducer comprising a balanced armature receiver including a diaphragm separating an internal volume of the rigid housing into a back volume and a front volume, the front volume including a sound port;

a vent port acoustically coupled to the internal volume;

the front volume acoustically coupled to the sound opening of the rigid housing, a portion of the rigid housing configured to be disposed at least partially in a user's ear, wherein sound produced by the transducer emanates from the sound port of the front volume and through the sound opening of the rigid housing;

an acoustic valve disposed in the rigid housing and located externally to the transducer, the valve having a first port acoustically coupled to the internal volume via the vent port, and the valve acoustically coupled to ambient atmosphere to the internal volume, the valve actuatable between an open state and a closed state, wherein actuation of the valve changes an acoustic characteristic of the hearing device.

2. The hearing device of claim 1, wherein acoustic impedance between the internal volume and the volume external to the internal volume is greater when the valve is in the closed state than when the valve is in the open state.

3. The hearing device of claim 1, wherein the actuation of the valve changes an acoustic output of the hearing device.

4. The hearing device of claim 1, wherein the acoustic valve is acoustically coupled to the back volume via the vent port.

5. The hearing device of claim 4 having a nominal acoustic performance when the valve is in the closed state, the nominal acoustic performance including a first resonant frequency, wherein the hearing device has a new first resonant frequency when the valve is in the open state and wherein an acoustic output of the hearing device is increased at frequencies less than the new first resonant frequency when the valve is in the open state.

6. The hearing device of claim 1 further comprising a sound transmissive contamination barrier disposed between the volume external to the rigid housing and the valve.

7. The hearing device of claim 1, the volume external to the internal volume is an effectively unbounded volume external to the rigid housing, wherein passage of sound between the transducer and the unbounded volume is attenuated more when the valve is in the closed state than when the valve is in the open state.

8. The hearing device of claim 1, the volume external to the internal volume is an effectively unbounded volume external to the rigid housing, wherein passage of sound between the unbounded volume and the sound opening is relatively attenuated when the valve is in the closed state than when the valve is in the open state.

9. The hearing device of claim 1, further comprising an acoustic damper disposed between the vent port of the acoustic transducer and the volume external to the internal volume.

10. A hearing device comprising:

a housing having a sound opening;

a sound-producing electroacoustic transducer disposed within the housing, the transducer comprising a balanced armature receiver including a diaphragm separating an internal volume of the housing into a back volume and a front volume, the front volume including a sound port;

a vent port acoustically coupled to the internal volume;

the front volume acoustically coupled to the sound opening of the housing, a portion of the housing configured to be disposed at least partially in a user's ear, wherein sound produced by the transducer emanates from the sound port of the front volume and through the sound opening of the housing;

an acoustic valve disposed in the housing, the valve having a first port acoustically coupled to the internal volume via the vent port, and the valve acoustically coupled to ambient atmosphere to the internal volume, the valve actuatable between an open state and a closed state, wherein actuation of the valve changes an acoustic characteristic of the hearing device;

wherein the acoustic valve is acoustically coupled to the back volume via the vent port; and having a nominal acoustic performance when the valve is in the closed state, the nominal acoustic performance including a first resonant frequency, wherein the hearing device has a new first resonant frequency when the valve is in the open state and wherein an acoustic output of the hearing device is increased at frequencies less than the new first resonant frequency when the valve is in the open state.

11. A hearing device comprising:

a housing having a sound opening;

a sound-producing electroacoustic transducer disposed within the housing, the transducer comprising a balanced armature receiver including a diaphragm separating an internal volume of the housing into a back volume and a front volume, the front volume including a sound port;

a vent port acoustically coupled to the internal volume;

the front volume acoustically coupled to the sound opening of the housing, a portion of the housing configured to be disposed at least partially in a user's ear, wherein sound produced by the transducer emanates from the sound port of the front volume and through the sound opening of the housing;

an acoustic valve disposed in the housing, the valve having a first port acoustically coupled to the internal volume via the vent port, and the valve acoustically coupled to ambient atmosphere to the internal volume, the valve actuatable between an open state and a closed state, wherein actuation of the valve changes an acoustic characteristic of the hearing device;

the volume external to the internal volume is an effectively unbounded volume external to the housing, wherein passage of sound between the unbounded volume and the sound opening is relatively attenuated when the valve is in the closed state than when the valve is in the open state.

* * * * *